US009962929B2

(12) United States Patent
Ono et al.

(10) Patent No.: US 9,962,929 B2
(45) Date of Patent: May 8, 2018

(54) PRINTING APPARATUS, CONTROL METHOD FOR PRINTING APPARATUS, AND PRINTING METHOD

(71) Applicants: National Institute of Technology, Tokyo (JP); MIMAKI ENGINEERING CO., LTD., Nagano (JP)

(72) Inventors: Nobuyuki Ono, Nagano (JP); Akira Takeuchi, Nagano (JP); Satoshi Kaneko, Nagano (JP); Eiichi Ohara, Nagano (JP)

(73) Assignees: National Institute of Technology, Tokyo (JP); MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/626,164

(22) Filed: Jun. 18, 2017

(65) Prior Publication Data

US 2018/0001625 A1 Jan. 4, 2018

(30) Foreign Application Priority Data

Jun. 30, 2016 (JP) ..... 2016-130692

(51) Int. Cl.

| | |
|---|---|
| ***B41J 3/407*** | (2006.01) |
| ***B41J 2/045*** | (2006.01) |
| *B41J 29/38* | (2006.01) |

(52) U.S. Cl.
CPC ..... *B41J 2/04508* (2013.01); *B41J 3/4073* (2013.01); *B41J 29/38* (2013.01)

(58) Field of Classification Search
CPC .. B41J 2/04505; B41J 2/04508; B41J 2/2135; B41J 3/4073; B41J 25/308; B41J 25/3086; B41J 29/38; B05B 12/12
See application file for complete search history.

(56) References Cited

U.S. PATENT DOCUMENTS 9,446,585 B2 * 9/2016 Goyal ..... B41J 3/36

FOREIGN PATENT DOCUMENTS

JP 2011177931 9/2011

* cited by examiner

*Primary Examiner* — Thinh H Nguyen
(74) *Attorney, Agent, or Firm* — JCIPRNET

(57) ABSTRACT

A three-dimensional printer including a printer head, a target object holding device that rotatably holds the printing target object, a three-dimensional movement supporting device that movably supports the target object holding device, and a control device, where the control device carries out a process of setting a printing target point, which is a position where the ink is to be discharged from a nozzle, an ideal landing point and an actual landing point are calculated in the relevant process, and when positions are shifted between the ideal landing point and the actual landing point, correction corresponding to a shift amount of the position is carried out to set a printing target point.

10 Claims, 19 Drawing Sheets

PRINTING APPARATUS, CONTROL METHOD FOR PRINTING APPARATUS, AND PRINTING METHOD

CROSS REFERENCE TO RELATED APPLICATIONS

This application claims the priority benefit of Japanese Patent Application No. 2016-130692, filed on Jun. 30, 2016. The entirety of the above-mentioned patent application is hereby incorporated by reference herein and made a part of this specification.

TECHNICAL FIELD

The present disclosure relates to a printing apparatus, a control method for the printing apparatus, and a printing method.

DESCRIPTION OF THE BACKGROUND ART

Various configurations have been conventionally considered for a configuration of a printing apparatus that carries out printing on a printing target object having a three-dimensional shape. For example, the inventor of the present application conducted researches and developments on a three-dimensional printer that moves a printing target object and a printer head to perform printing on a surface of a three-dimensional object while maintaining a relative position relationship of the printing target object and the printer head (see e.g., Japanese Unexamined Patent Publication No. 2011-177931).

SUMMARY

When a printing apparatus having a configuration same as or similar to the three-dimensional printer disclosed in Japanese Unexamined Patent Publication No. 2011-177931 is used, various images and the like can be printed at high precision on a surface of the printing target object of various shapes. However, the inventor of the present application has found, through thorough researches, that depending on the shape of the printing target object, a shift (landing shift) may occur between an ideal landing point and a landing point where landing can be actually made with respect to a landing point (landing position) where an ink is to be landed on the printing target object due to the configuration of the printing apparatus. The inventor has found out that the quality of the image to be printed may lower as a result.

More specifically, when using a printing apparatus having a configuration same as or similar to the three-dimensional printer disclosed in Japanese Unexamined Patent Publication No. 2011-177931, a nozzle row in which a plurality of nozzles are lined in a predetermined nozzle row direction is usually formed on a nozzle surface of the printer head. In this case, there is a constraint on the configuration in which the plurality of nozzles are linearly lined in the nozzle row. As a result, the position where the ink is landed during the operation of printing is restricted. In this case, the image quality may be affected depending on the shape of the printing target object.

Furthermore, in the printing apparatus, the greater the number of nozzles in the nozzle row is, the faster the printing speed usually becomes. Thus, when attempting to realize a practical printing speed, the nozzle row usually needs to have a certain length or greater. When the length of the nozzle row becomes long, the influence of the constraint on the configuration of the nozzle row described above becomes greater. As a result, the lowering in the quality of the image to be printed may become a problem. The present disclosure thus provides a printing apparatus, a control method for the printing apparatus, and a printing method capable of solving the problems described above.

The inventor of the present disclosure further conducted a thorough research on the method capable of solving the problems described above. The inventor has discovered that the influence on the image quality can be suppressed by carrying out a correction corresponding to the influence of the constraint on the configuration of the nozzle row. More specifically, with respect to a process of setting a printing target point, which is a position where the ink is to be discharged from each nozzle in the nozzle row, on the surface of the printing target object, consideration is given to calculating an ideal landing point, which is a landing point calculated without limiting a condition that the nozzles are linearly lined in the nozzle row, and an actual landing point, which is a landing point calculated under a condition that a plurality of nozzles are linearly lined in the nozzle row; carrying out correction corresponding to a shift amount in the positions of both landing points; and setting a printing target point. The inventor has thereby discovered that printing of higher quality can be carried out.

In other words, the present disclosure provides a printing apparatus that carries out printing on a surface of a printing target object having a three-dimensional shape based on a print image, which is an image to be printed, the printing apparatus including a printer head including a nozzle surface being a surface formed with a nozzle row where a plurality of nozzles, each of which discharges ink, are lined in a predetermined nozzle row direction; a target object holding device that holds the printing target object, the target object holding device rotatably holding the printing target object with a rotating axis set in a three-dimensional space as a center; a three-dimensional movement supporting device that movably supports the target object holding device in the three-dimensional space; a head movement supporting device that movably supports the printer head so that the nozzle surface passes a position facing the surface of the printing target object held by the target object holding device; a relative movement control device that carries out a control of relatively moving the printer head with respect to the printing target object held by the target object holding device by controlling an operation of the three-dimensional movement supporting device and the head movement supporting device; and a print control device that controls discharging of the ink from the printer head, the print control device setting a printing target point, which is a position where the ink is to be discharged from at least some nozzles in the nozzle row, on the surface of the printing target object, and discharging the ink from a nozzle in the nozzle row to the printing target point based on the print image in accordance with the control of the relative movement by the relative movement control device. In this printing apparatus, the print control device carries out, for a process of setting the printing target point, at least an ideal landing point calculation process of calculating an ideal landing point, which is an ideal landing point of the ink discharged from the nozzle in the nozzle row, the ideal landing point calculation process calculating the ideal landing point based on the shape of the surface of the printing target object without limiting a condition that the plurality of nozzles are linearly lined in the nozzle row, an actual landing point calculation process of calculating an actual landing point, which is a landing point of the ink dischargeable from the nozzle in the nozzle row, the actual landing point calculation process calculating the actual landing point based on the shape of the surface of the printing target object under a condition that the plurality of nozzles are linearly lined in the nozzle row, and a printing target point setting process of setting the printing target point on the surface of the printing target object, the printing target point setting process setting the printing target point with respect to each position based on the ideal landing point and the actual landing point corresponding to each position on the surface of the printing target object; and when positions are shifted between the ideal landing point and the actual landing point corresponding to an identical position on the surface of the printing target object, correction corresponding to a position shift amount is carried out to set the printing target point in the printing target point setting process.

According to such configuration, for example, the correction corresponding to the position shift amount can be appropriately carried out even when the shift in position occurs between the ideal landing point and the actual landing point. Furthermore, for example, the quality of the image to be printed thus can be appropriately prevented from being influenced by the influence of the configuration of the nozzle row, and high quality printing can be carried out.

Here, with regards to the ideal landing point, when referring to being the ideal landing point, this means, for example, being truly set by the surface shape of the printing target object. Furthermore, in this case, when referring to being true by the surface shape of the printing target object, this means that shift and the like by the condition that the nozzles are linearly lined does not occur.

Use of the control method for the printing apparatus and the printing method having characteristics similar to the above is also considered for the configuration of the present disclosure. In such cases as well, for example, effects similar to the above can be obtained.

According to the present disclosure, for example, high quality printing can be more appropriately carried out with respect to a surface of a printing target object having a three-dimensional shape.

BRIEF DESCRIPTION OF THE DRAWINGS

FIG. 1A is a front view of the three-dimensional printer 10. FIG. 1B is a side view of the three-dimensional printer 10.

FIGS. 3A and 3B show one example of the operation of carrying out printing on the printing target object 50 having an elliptical column shape. FIGS. 3C and 3D show one example of an operation of carrying out printing on the printing target object 50 having a truncated circular cone shape.

FIG. 4A is a view showing a model of a shape (work shape) of a work, which is a printing target object. FIG. 4B shows one example of a process of forming cross-sectional data from STL data.

FIG. 5A is a view showing one example of cross-sectional point group data obtained from the STL data. FIG. 5B is a view showing one example of an equal interval process of the point group. FIG. 5C is a view showing one example of a result of rearranging the point group (dot row) in the cross-section to equal interval.

FIGS. 6A and 6B are views showing one example of the outer shape data obtained by a process of the present example.

FIG. 7A shows one example of a relationship of a number of main scanning operations (number of scans) and a dot position of an image. FIGS. 7B and 7C show one example of a method for obtaining a start point coordinate and an end point coordinate.

FIG. 8A is a view showing one example of a relationship of the work shape and the print nozzle row. FIG. 8B is a view describing a calculation method of a B axis rotation angle. FIG. 8C is a view showing one example of a state after the B axis rotation.

FIG. 9A is a view showing one example of a state before the C axis rotation. FIG. 9B is a view showing one example of a state after the C axis rotation.

FIG. 10A is a view showing one example of a state before the A axis rotation. FIG. 10B is a view showing one example of a state after the A axis rotation.

FIG. 11A is a view showing one example of an offset in the ABC axes. FIG. 11B shows one example of a relationship of the machine coordinate system and the work coordinate system.

FIG. 13A is a view showing one example of a change in an inter-dot distance by a peripheral length. FIG. 13B shows one example of a change in an actual landing point and an ideal landing point. FIG. 13C schematically shows a mechanism of occurrence of a landing error.

FIG. 14A shows one example of a change in the landing error (dot landing error) at the printing position. FIG. 14B is a view showing one example of a result of carrying out printing while the landing error is occurring.

FIG. 15A shows one example of a result of correcting the image based on the landing error. FIG. 15B is a view showing a result of carrying out printing using the corrected image.

DETAILED DESCRIPTION OF EMBODIMENTS

Figure 1A:
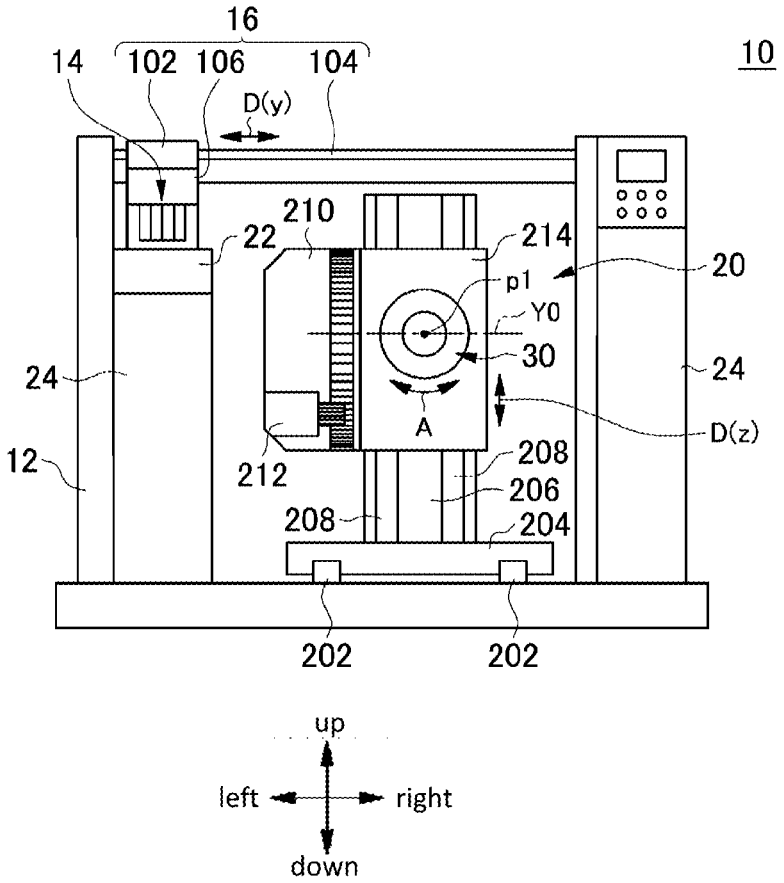
FIGS. 1A and 1B are views showing one example of a three-dimensional printer 10, which is a printing apparatus according to one embodiment of the present disclosure.
Figure 1B:
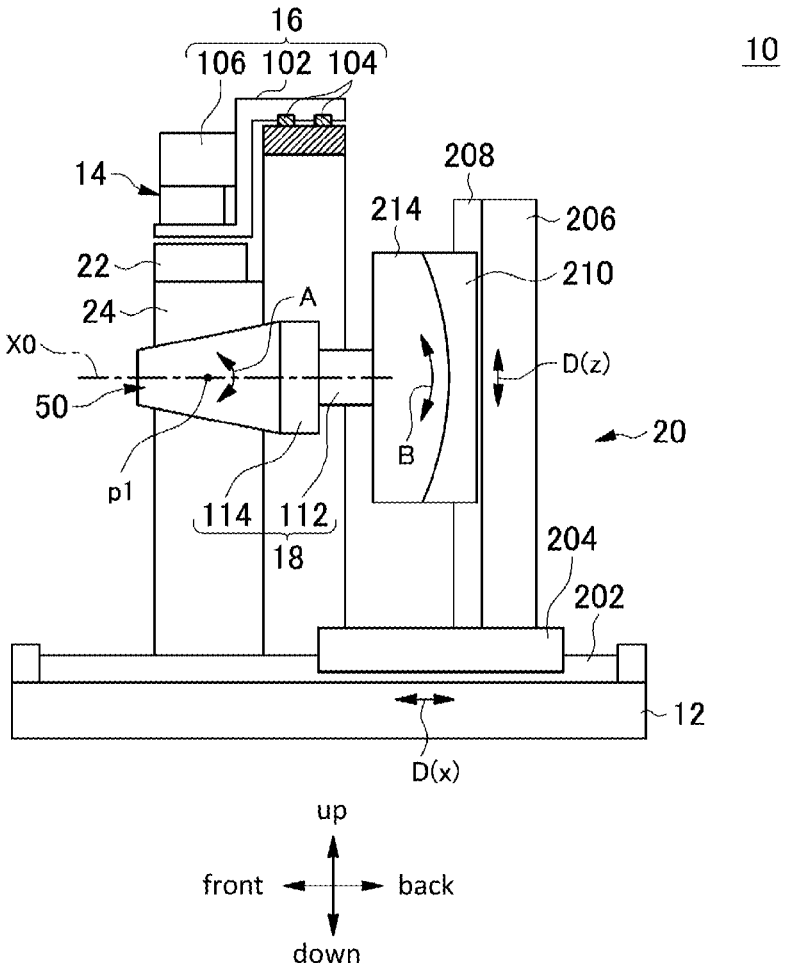

Hereinafter, an embodiment according to the present disclosure will be described with reference to the drawings. FIGS. 1A and 1B show one example of a configuration of a three-dimensional printer 10, which is a printing apparatus according to one embodiment of the present disclosure. FIG. 1A is a front view of the three-dimensional printer 10. FIG. 1B is a side view of the three-dimensional printer 10.

Hereinafter, as shown with arrows in FIGS. 1A and 1B, left and right direction and up and down direction when the three-dimensional printer 10 is seen from the front are simply referred to as left and right direction and up and down direction, respectively. A depth direction of the three-dimensional printer 10 is referred to as back direction, and an opposite side is referred to as front direction. In this case, the front surface of the three-dimensional printer 10 is a surface illustrated in the plane of drawing of FIG. 1A. The depth direction of the three-dimensional printer 10 is a direction on a right side in FIG. 1B.

The three-dimensional printer 10 is a printing apparatus (printer device) that carries out printing on a surface of a printing target object 50 having a three-dimensional shape based on a print image which is an image to be printed, and includes a cabinet section 12, a printer head 14, a head movement supporting mechanism 16, a target object holding device 18, a three-dimensional movement supporting device 20, a maintenance station 22, and a control device 24. In this case, the printing target object 50 is an object (work) to become the target of printing. In the present example, a three-dimensional object (3D object) of various shapes is used for the printing target object 50. The three-dimensional printer 10 may be a printing apparatus that can perform printing on the printing target object 50, which is a three-dimensional object, of various shapes such as circular cylinder, circular cone, sphere, and the like.

Excluding the points described below, the three-dimensional printer 10 may have features same as or similar to the known three-dimensional printer. For example, other than the illustrated configuration, the three-dimensional printer 10 may further include a power supply, a power supply control device, and the like. More specifically, excluding the points described above and below, the three-dimensional printer 10 in the present example may have features same as or similar to the three-dimensional printer disclosed in Japanese Unexamined Patent Publication No. 2011-177931.

The cabinet section 12 is a section that configures a cabinet of the three-dimensional printer 10. In the present example, the cabinet section 12 is configured by a base portion, a gate type supporting frame, and the like. The base portion is a supporting portion configuring a bottom surface portion of the three-dimensional printer 10. The gate type supporting frame is a gate type frame portion securely arranged on the base portion. More specifically, in the illustrated configuration, the gate type supporting frame includes a left supporting leg and a right supporting leg, and a supporting beam extending to the left and right so as to connect the upper ends of the left and right supporting legs.

The printer head 14 is an ink jet head that discharges ink (ink droplet) through an ink jet method. In the present example, the printer head 14 has a nozzle surface, which is a surface where a nozzle row is formed. In this case, the nozzle row is a row in which a plurality of nozzles (not shown), each of which discharges ink, are lined in a predetermined nozzle row direction. More specifically, in the present example, the nozzle surface of the printer head 14 is a lower surface of the printer head 14. A great number of nozzles are formed on the nozzle surface of the printer head 14 so as to form a row extending in a direction orthogonal to a moving direction of the printer head 14, where ink of the same color or different color with respect to each other is discharged from the respective nozzles. In this case, the printer head 14, for example, discharges the ink supplied from an ink supplying device (not shown) for every nozzle based on the control of the control device 24 to perform a predetermined printing on the surface of the printing target object 50.

The three-dimensional printer 10 may include a plurality of printer heads 14. In this case, each of the plurality of printer heads 14, for example, discharges ink of a color different from each other. Furthermore, in such a case, the plurality of printer heads 14 are, for example, arranged lined in a predetermined direction (e.g., left and right direction in the figure).

The head movement supporting mechanism 16 is an example of a head movement supporting device, and movably holds the printer head 14. In the present example, the head movement supporting mechanism 16 movably supports the printer head 14 such that the nozzle surface passes a position facing the surface of the printing target object 50 held by the target object holding device 18. More specifically, in the illustrated configuration, the head movement supporting mechanism 16 includes a carriage 102, a guide rail 104, and a head driving device 106.

The carriage 102 is a holding member that holds the printer head 14 so as to face the printing target object 50. The carriage 102 is arranged to be movable along the guide rail 104, and is moved in the left and right direction in the figure indicated-by an arrow D(y) in response to an instruction of the control device 24. In the present example, as shown in FIG. 1B, the carriage 102 is a member having a crank shape in side view that is extended toward a front side from a portion supported by the guide rail 104, bent toward the lower side, and then further extended toward the front side. In this case, the printer head 14 is, for example, attached to a front end portion of the carriage 102 as shown in the figure. The front end portion of the carriage 102 has a portion facing the lower surface of the printer head 14 and being vertically opened. According to such configuration, for example, the ink can be appropriately discharged toward the surface of the printing target object 50 located below the front end portion of the carriage 102 from the printer head 14 held by the carriage 102. The printer head 14, for example, thus can be caused to appropriately carry out the desired printing.

The guide rail 104 is a pair of rails (left and right guide rails) arranged to extend in the left and right direction at a position between the left supporting leg and the right supporting leg on the upper surface of the supporting beam in the cabinet section 12. According to such configuration, the guide rail 104 holds the carriage 102 so as to be freely movable in the left and right direction. The head driving device 106 is a driving device that moves the printer head 14 in the up and down direction. In the present example, the head driving device 106 is, for example, arranged above the printer head 14, and moves the printer head 14 in the up and down direction in response to the instruction of the control device 24.

The target object holding device 18 is a device that holds the printing target object 50. In the present example, the target object holding device 18 rotatably holds the printing target object 50 with a rotating axis set in a three-dimensional space as the center.

More specifically, in the illustrated configuration, the target object holding device 18 includes a holding shaft 112 and a holding chuck 114. The holding shaft 112 is a shaft-like member extending in the front and back direction in the three-dimensional printer 10, and is arranged to project out toward the front side of the three-dimensional printer 10 in a freely rotating manner with a rotating axis X0 passing through a predetermined point p1 as the center. The predetermined point p1 is a point of a predetermined position set in advance as a position where the printing target object 50 can be located. For the sake of convenience of explanation, the rotating axis X0 is hereinafter referred to as a second rotating axis X0. The holding shaft 112 is rotatably driven by a drive motor (not shown) arranged inside a third supporting member 214 in a three-dimensional movement supporting device 20 to be described later.

In the present example, the holding chuck 114 is attached to the front end of the holding shaft 112. The holding chuck 114 is a chuck member capable of holding the printing target object 50, and holds the printing target object 50 at the time of printing. When configured in such manner, for example, the holding shaft 112 is rotatably driven while having the printing target object 50 held by the holding chuck 114, so that the printing target object 50 can be rotated in a direction of an arrow A (hereinafter referred to as A axis direction) with the second rotating axis X0 as the center.

The three-dimensional movement supporting device 20 is a device that movably supports the target object holding device 18 in the three-dimensional space. In the present example, the three-dimensional movement supporting device 20 includes a guide rail 202, a first supporting member 204, a perpendicular supporting member 206, a guide rail 208, a second supporting member 210, a third supporting member 214, and a drive motor 212.

The guide rail 202 is a pair of rails arranged on the upper surface of the base portion in the cabinet section 12, and is arranged to extend in the front and back direction in the figure, as indicated with an arrow D(x), to guide the movement of the first supporting member 204 in the front and back direction. The first supporting member 204 is a supporting member arranged to freely move in the front and back direction by the guide rail 202.

The perpendicular supporting member 206 is a supporting member arranged in a perpendicularly standing manner on the upper part of the first supporting member 204. According to such configuration, the perpendicular supporting member 206 is moved in the front and back direction with the first supporting member 204.

The guide rail 208 is a pair of left and right rails (upper and lower guide rails) extending in the up and down direction at the front side of the perpendicular supporting member 206 to guide the movement of the second supporting member 210 in the up and down direction indicated with an arrow D(z). The second supporting member 210 is a supporting member supported in a freely moving manner in the up and down direction by the guide rail 208. In the present example, a front surface of the second supporting member 210 is formed to have a cylindrical surface shape having a rotating axis Y0, which passes through the predetermined point p1 described above and extends in the left and right direction, as the center. For the sake of convenience of explanation, the rotating axis Y0 is hereinafter referred to as a first rotating axis Y0. In this case, the predetermined point p1 may be considered as a predetermined point defined with respect to the second supporting member 210.

Furthermore, in the present example, the third supporting member 214 is arranged on the front surface side of the second supporting member 210. The third supporting member 214 is a supporting member having a back surface of a cylindrical surface shape. The back surface is a surface that joins with the front surface having a cylindrical surface shape in the second supporting member 210, where the third supporting member 214 is arranged to be freely slidable along the front surface a of the second supporting member 210 by joining the back surface of the third supporting member 214 and the entire surface of the second supporting member 210. In other words, the back surface of the third supporting member 214 can slidably move with the front surface of the second supporting member 210. Thus, the third supporting member 214 is supported in a freely rotating manner with the first rotating axis Y0 as the center with respect to the second supporting member 210. In the present example, when referring to being freely rotatable with the first rotating axis Y0 as the center, this means being freely rotatable in a direction indicated with an arrow B in the figure.

The drive motor 212 is a drive means for rotating the third supporting member 214. In the present example, the drive motor 212 is arranged on the front surface of a left side part of the third supporting member 214, as shown in FIG. 1A, to rotate the third supporting member 214, supported as described above, with the first rotating axis Y0 as the center with respect to the second supporting member 210. In this case, for example, a drive pinion attached to a drive shaft (not shown) of the drive motor 212 and an internal gear on the third supporting member 214 side are geared to rotatably drive the drive pinion by the drive motor 212. According to such configuration, for example, the third supporting member 214 can be appropriately rotated in a direction (hereinafter referred to as a B axis direction) indicated with the arrow B with the first rotating axis Y0 as the center by rotating the internal gear according to the rotation of the drive pinion.

Furthermore, the third supporting member 214 thus can be freely rotated in the B axis direction with the first rotating axis Y0 as the center, as described above. Thus, for example, as in the state shown in FIG. 1B, when the third supporting member 214 is located at a predetermined rotation position, the second rotating axis X0 is extended in the front and back direction. In such a state, the holding shaft 112 that rotates the printing target object 50 with respect to the second rotating axis X0 is extended in the front and back direction at the front surface side of the third supporting member 214. Moreover, when the third supporting member 214 is rotated in the B axis direction, the second rotating axis X0 is swung up and down according to the rotation of the third supporting member 214 in the B axis direction.

The maintenance station 22 has a configuration for carrying out maintenance on the nozzle at the lower surface of the printer head 14. In the illustrated configuration, the maintenance station 22 is arranged on the left end side of a moving range of the carriage 102 mounted with the printer head 14. The maintenance station 22, for example, carries out cleaning and anti-drying treatment of the nozzle at the lower surface of the printer head 14 while the carriage 102 is located at the left end part.

The control device 24 is a device that carries out the control of the operation of the three-dimensional printer 10, and controls the operation of each unit of the three-dimensional printer 10. The control device 24 may be, for example, a portion including a CPU of the three-dimensional printer 10. In the present example, the control device 24, for example, accepts an instruction of a user through an operation panel, and controls the operation of the three-dimensional printer 10 in response to the instruction.

More specifically, in the present example, the control device 24 at least functions as a relative movement control device and a print control device. In this case, the relative movement control device is, for example, a device that controls the operations of the head movement supporting mechanism 16, the three-dimensional movement supporting device 20, and the like to carry out a control of relatively moving the printer head 14 with respect to the printing target object 50 held by the target object holding device 18. The relative movement control device can also be considered as, for example, a movement control device that carries out the control of parallel movement and rotation movement in the three-dimensional printer 10.

The print control device is, for example, a device that carries out a control of the discharging of ink from the printer head 14. More specifically, in the present example, the print control device is a device that sets a printing target point, which is a position where the ink is to be discharged from each nozzle of at least one part of the nozzle row, on the surface of the printing target object 50, and discharges the ink to the printing target point from each nozzle in the nozzle row based on a print image in accordance with the control of the relative movement by the relative movement control device.

The specific control carried out as the relative movement control device and the print control device will be described later in further detail. In the illustrated configuration, the control device 24 is a device that serves both as the relative movement control device and as the print control device, and is arranged divided to the right side and the left side of the three-dimensional printer 10. In other examples of the configuration of the three-dimensional printer 10, the control device 24 may be arranged with a configuration different from FIGS. 1A and 1B. Furthermore, for example, the relative movement control device and the print control device may be separately arranged.

Figure 2:
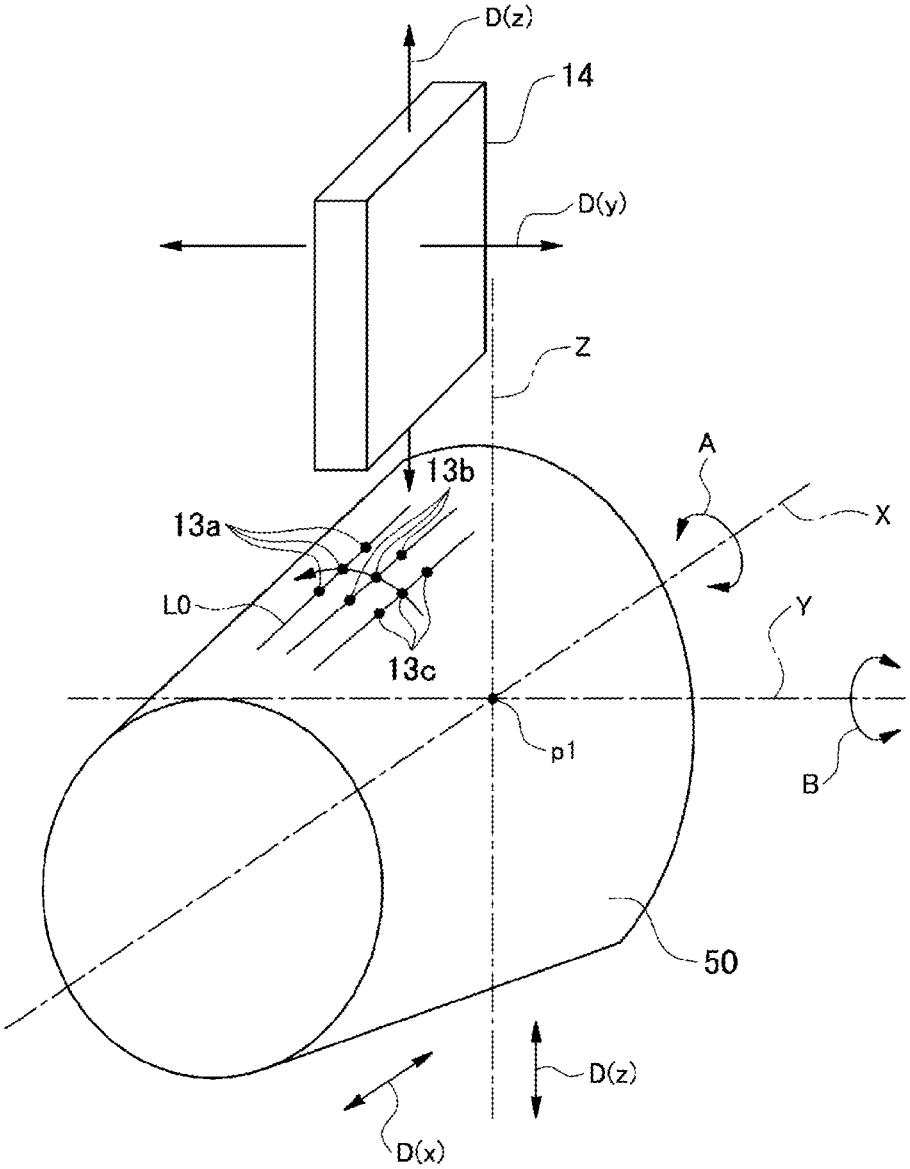
FIG. 2 is a view describing an operation of printing carried out by the three-dimensional printer 10.

Next, an operation of printing carried out by the three-dimensional printer 10 will be described in further detail. FIG. 2 is a view describing an operation of printing carried out by the three-dimensional printer 10, and shows one example of an operation principal in which printing is performed on the printing target object 50 by the three-dimensional printer 10 described using FIGS. 1A and 1B, and an outline of the relative movement control of the printing target object 50 and the printer head 14.

In FIG. 2, the second rotating axis X0 acting as the center of rotation of the holding shaft 112 corresponds to an X axis, and the first rotating axis Y0 acting as the center of rotation of the third supporting member 214 corresponds to a Y axis. Furthermore, the printing target object 50 shown in FIG. 2 is a member having a truncated circular cone shape. Hereinafter, a description will be made using such printing target object 50. The shape of the printing target object 50 that can be printed with the three-dimensional printer 10 is not limited to the truncated circular cone shape, and may take various shapes such as cylindrical shape, elliptic tubular shape, circular cone shape, and the like.

As described above, in the present example, the three-dimensional printer 10 supports the printing target object 50 with the first supporting member 204, the second supporting member 210, the third supporting member 214, the holding chuck 114, and the like shown in FIGS. 1A and 1B. Furthermore, according to such configuration, the printing target object 50 is supported to freely rotate in the A axis direction with the X axis as the center. In this state, the printing target object 50 is supported to freely rotate in the B axis direction with the Y axis, passing through the predetermined point p1 on the X axis and extending to the left and right so as to be orthogonal to the X axis, as the center. Furthermore, the printing target object 50 is configured to be supported so as to be movable in the front and back direction as indicated with the arrow D(x) along the X axis direction and movable in the up and down direction as indicated with the arrow D(z) along the Z axis extending perpendicularly so as to be orthogonal to the X axis and the Y axis.

Above the printing target object 50 supported in the above manner, the printer head 14 is arranged so as to be movable in the Y axis direction indicated with the arrow D(y). The printer head 14 can be moved in the Z axis direction indicated with the arrow D(z) by the head driving device 106 (see FIGS. 1A and 1B).

When carrying out printing with respect to the printing target object 50, the nozzle in the printer head 14 needs to be located at a close position of a predetermined printing interval from the printing target position on the surface of the printing target object 50. This position is, for example, a position of an interval suited for attaching the ink discharged from the nozzle on the surface of the printing target object 50 and carrying out the printing. Furthermore, in this case, the discharging direction of the ink from the nozzle needs to be directed in an orthogonal direction with respect to the printing target position on the surface of the printing target object 50. Specifically, for example, as shown in the figure, it needs to be moved such that the lower surface (nozzle surface) of the printer head 14 becomes parallel to a tangent plane having a middle point of a printing line 13*a* including the printing target point as a tangent point, and such that the nozzle surface is located spaced apart by a predetermined printing interval from the relevant middle point.

In the three-dimensional printer 10 of the present example, the printing target object 50 is first moved in the X axis direction indicated with the arrow D(x) to carry out the movement described above. The printing target object 50 is then rotated in the A axis direction and located so that the printing line 13*a* of the printing target faces straight above. Furthermore, the printing target object 50 is rotated in the B axis direction and located such that the nozzle row of the printer head 14 and a ridge line L0 passing through the printing line 13*a* are parallel to each other. It is then moved in the direction indicated with the arrow D(z) so that the nozzle surface of the printer head 14 is located at a position spaced apart by a predetermined printing interval from the middle point of the printing line 13*a*. The movement, rotation, and the like may be carried out in any order as long as the printing target object 50 and the printer head 14 do not interfere.

In the three-dimensional printer 10 of the present example, the ink is discharged from the nozzle to the printing line 13*a* with the nozzle surface of the printer head 14 made parallel to the tangent plane of the middle point of the printing line 13*a* and with the nozzle surface of the printer head 14 spaced apart by the predetermined printing interval from the middle point of the printing line 13*a*, as described above, by carrying out the movement and the rotation described above. Furthermore, for example, when carrying out the discharging of ink with respect to a printing line 13*b* and a printing line 13*c*, formed at positions along a circumferential direction in the surface of the printing target object 50 from the printing line 13*a* and extending in the X axis (rotating axis) direction, the ink is discharged while carrying out parallel movement and rotation movement of the printer head 14 and the printing target object 50 so that the nozzle surface of the printer head 14 is spaced apart by the predetermined printing interval from the respective middle points, and the nozzle surface of the printer head 14 becomes parallel to the tangent plane of the respective middle points of the printing line 13*b* and the printing line 13*c*, similar to the time of printing with respect to the printing line 13*a*. Accordingly, the ink is discharged to the printing line 13*b* and the printing line 13*c* with the nozzle surface of the printer head 14 spaced apart from the printing line 13*b* and the printing line 13*c* by the predetermined printing distance and the nozzle surface of the printer head 14 located so as to be parallel to the tangent plane of the respective middle points of the printing line 13*b* and the printing line 13*c*. In other words, in the present example, the desired printing can be carried out by sequentially discharging the ink at a constant interval to the printing line 13*a*, the printing line 13*b*, the printing line 13*c*, at the surface of the printing target object 50.

As described above, the three-dimensional printer 10 in the present example includes a 5-axes moving mechanism with the X axis for moving the printing target object 50 in the nozzle row direction of the printer head 14, the Y axis provided in the direction orthogonal to the X axis for moving the printer head 14, the Z axis for moving the printer head 14 and the printing target object 50 in the up and down direction, the A axis for rotating the printing target object 50 with the X axis as the center, and the B axis for rotating the printing target object 50 with the Y axis as the center. This allows printing to be carried out at high precision on, for example, the printing target object 50 of various shapes.

Figure 3A:
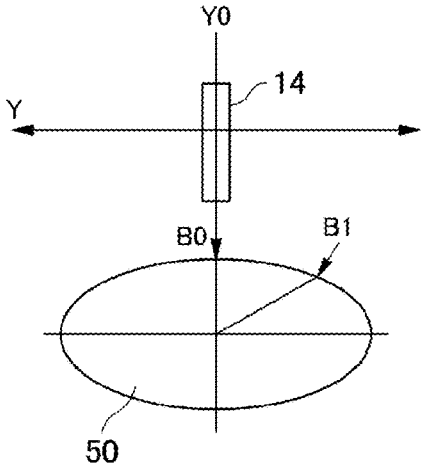
FIGS. 3A to 3D are views showing one example of the operation of printing with respect to a printing target object 50 of various shapes.
Figure 3B:
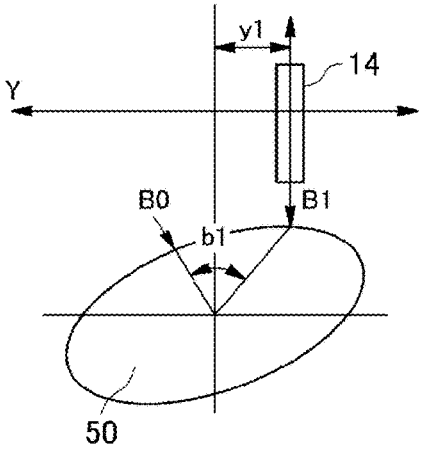

FIGS. 3A and 3B show one example of the operation of printing with respect to the printing target object 50 of various shapes. FIGS. 3A and 3B show one example of the operation of carrying out printing on the printing target object 50 having an elliptical column shape. FIG. 3A shows one example of an operation at the timing of discharging the ink on the printing line located at a predetermined printing reference point B0, which is a part of the surface of the printing target object 50. FIG. 3B shows one example of the operation at the timing of discharging the ink to a printing line, which is a part of the surface of the printing target object 50 and located at a printing target point B1 spaced apart from a printing reference point B0.

When carrying out the printing with respect to the printing target object 50 of various shapes, it is preferable to always make the perpendicular Y0 axis of the printer head 14 and a normal direction in the printing line coincide with each other with respect to the surface of the printing target object 50 in order to land the ink at satisfactory precision. Thus, in the present example, when carrying out the printing on the printing line located at the printing target point B1 spaced apart from the printing reference point B0, for example, the printer head 14 is moved to the position of y1 to carry out printing while rotating the printing target object 50 in the A axis direction by a rotation angle b1, as shown in FIG. 3B. According to such configuration, for example, the landing precision of the ink can be appropriately enhanced.

Figure 3C:
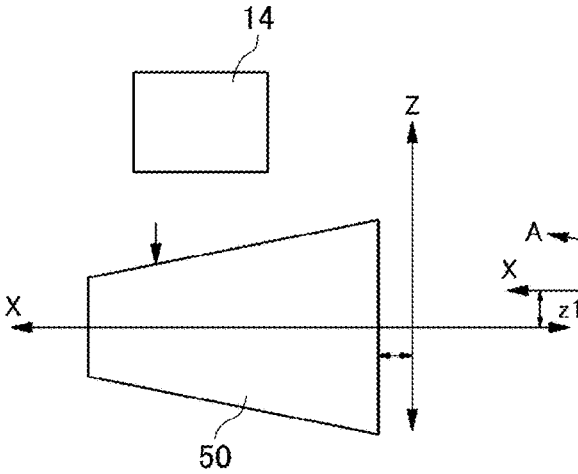
Figure 3D:
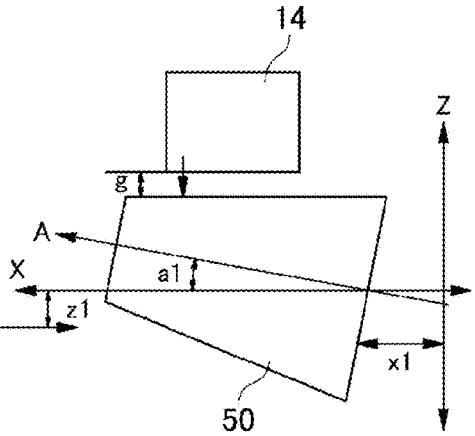

FIGS. 3C and 3D show one example of an operation of carrying out printing on the printing target object 50 having a truncated circular cone shape. FIG. 3C shows one example of a state before inclining the printing target object 50. FIG. 3D shows one example of a state in which the printing target object 50 is inclined and the orientation of the printing target object 50 is adjusted.

When carrying out the printing on the printing target object 50 having the truncated circular cone shape, the surface of the printing target object 50 and the nozzle surface of the printer head 14 are preferably made parallel. More specifically, if the printing target object 50 is an object having curvature like the printing target object 50 having the truncated circular cone shape, for example, the A axis is inclined in the B axis direction by an inclination angle al so that the tangent plane of the printing target point becomes parallel to the nozzle surface, as shown in FIG. 3D. Furthermore, to maintain a distance g between the nozzle surface of the printer head 14 and the printing region of the printing target object 50 constant, a reference point of the printing region and a reference point of the nozzle are made to coincide with each other with the Z coordinate as z1 and the X coordinate as x1. According to such configuration, for example, the landing precision of the ink can be appropriately enhanced.

Considering the control of the operation of printing described above in a more generalized manner, with regards to the operation of the control device 24 (see FIGS. 1A and 1B) serving as the relative movement control device, the control of the relative movement is preferably carried out so that the nozzle surface of the printer head 14 maintains a predetermined interval with respect to the printing target point and the nozzle surface becomes parallel to the tangent plane of the printing target point. In this case, the control device 24, for example, carries out a process of obtaining, from the surface shape of the printing target object 50 held by the target object holding device 18, a line segment of the same length as the nozzle row provided on an outer peripheral curve of the printing target object 50 in an orthogonal plane, and a normal vector orthogonal to the tangent plane of the printing target point. The orthogonal plane is orthogonal to a reference plane and passes through the rotating axis, and the reference plane becomes a reference when starting the printing on the printing target object 50 and is orthogonal to the rotating axis. The control of relatively moving the printer head 14 with respect to the printing target object 50 is carried out so that the nozzle row faces the line segment and the nozzle surface becomes orthogonal to the normal vector.

In the process of obtaining the line segment and the normal vector, consideration is made to, for example, carry out a first process of obtaining an outer peripheral curve of the printing target object 50 at the reference plane; a second process of executing an operation of obtaining the outer peripheral curve of the printing target object 50 at an orthogonal plane for every orthogonal plane spaced apart for every interval defined based on a predetermined printing resolution on the outer peripheral curve obtained by the first process; a third process of defining a point spaced apart by a distance of the same length as the nozzle row from the reference point on the outer peripheral curves on the plurality of outer peripheral curves obtained by the second process, and executing an operation of interpolating the defined points to obtain a curve for every reference point spaced apart for every distance from the outer peripheral curve obtained by the first process; a fourth process of sectionalizing the outer peripheral curve obtained by the second process by the outer peripheral curve obtained by the first process and a plurality of curves obtained by the third process to obtain a line segment; and a fifth process of obtaining a normal vector perpendicular to a middle point from the respective middle points of the line segments obtained by the fourth process.

Next, an operation of printing carried out in the three-dimensional printer 10 of the present example will be more specifically described. In the present example, when carrying out printing in the three-dimensional printer 10, processes of acquisition of outer shape data, calculation of print pass coordinate, generation of machine coordinate, and image correction are carried out based on the shape of the printing target object 50. Furthermore, the printing coordinate generation, the image correction, and the like are carried out based on such results, and the control device 24

(see FIGS. 1A and 1B) is caused to perform the operations of the relative movement control device and the print control device to carry out the printing on the printing target object 50. Each of such processes will be hereinafter specifically described in relation to one example of a specific control carried out by the control device 24 serving as the relative movement control device and the print control device.

In the above description, the configuration and the operation in the case where the three-dimensional printer 10 includes a movement mechanism of five axes of the X axis, the Y axis, the Z axis, the A axis, and the B axis have been mainly described using FIGS. 1A to 3D. In contrast, one example of the configuration and the operation in the case where the three-dimensional printer 10 includes a movement mechanism of six axes including a C axis, which is another rotating axis, in addition to the above five axes will be hereinafter described for the sake of convenience of explanation. The configuration and the operation in the case where the movement mechanism of six axes is included are the configuration same as or similar to, for example, the configuration and the operation described using FIGS. 9A and 9B in Japanese Unexamined Patent Publication No. 2011-177931. The definition of each axis of XYZABC described below is partially different from the definition of each axis of the three-dimensional printer 10 described using FIGS. 1A to 3D, due to the influence of the difference in the number of rotating axes, the sake of convenience of explanation, and the like. The features of each axis of XYZABC in the configuration described below will be hereinafter described anew, as necessary.

In order to perform printing on the surface of the printing target object 50 having a three-dimensional 3D shape, the printing coordinate, which is coordinate data, for scanning the printer head 14 with respect to the surface of the printing target object 50 needs to be generated from the 3D shape data indicating the shape of the printing target object 50. In the present example, the generation of the printing coordinate is carried out, and the process of image correction is further carried out to generate scan data for controlling the operation of the printer head 14 at the time of printing.

Each process will be specifically described below. First, the process of acquiring the outer shape data will be described.

In order to perform printing on the printing target object 50 using the printing target object 50, which is a 3D object, as a work, the main scanning operation (scan) and the sub-scanning operation need to be carried out in a manner of going over the surface of the printing target object 50. In this case, the main scanning operation is, for example, the operation of discharging the ink from the nozzle of the printer head 14 while relatively moving the printer head 14 with respect to the printing target object 50 in the main scanning direction set in advance. The sub-scanning operation is, for example, the operation of relatively moving the printer head 14 with respect to the printing target object 50 in the sub-scanning direction orthogonal to the main scanning direction. In this case, a region to be discharged with ink in each main scanning operation in the printing target object 50 is changed by carrying out the sub-scanning operation between the main scanning operations. More specifically, in the three-dimensional printer 10 of the present example, the main scanning operation and the sub-scanning operation are carried out with the left and right direction shown in FIGS. 1A and 1B as the main scanning direction, and the front and back direction as the sub-scanning direction. In this case, the main scanning operation and the sub-scanning operation are executed by causing the control device 24 to function as the relative movement control device and the print control device.

In the three-dimensional printer 10, the main scanning operation and the sub-scanning operation need to be controlled according to the shape of the printing target object 50 to appropriately carry out the main scanning operation and the sub-scanning operation. Thus, in the present example, the shape data indicating the shape of the surface of the printing target object 50 is acquired, and the outer shape data (outline) indicating the shape of the surface of the printing target object 50 in a predetermined format is acquired (generated) based on the acquired shape data.

Furthermore, in the present example, the 3D data indicating the three-dimensional shape of the printing target object 50 is acquired as the shape data of the printing target object 50, as will be described below. The outer shape data is then calculated based on the shape data. Furthermore, data for generating the coordinate data for scanning necessary for the operation control of printing is calculated for the outer shape data. More specifically, in the present example, cross-sectional point group data in which the 3D data is acquired at a constant distance in the axial direction, for example, is calculated for the outer shape data.

The surface shape of the printing target object 50 needs to be defined in advance to scan the printer head (print head) with respect to the surface of the printing target object 50, which is the 3D object, and form an image on the surface of the printing target object 50. In this case, the data indicating the shape of the printing target object 50 is handled as will be described below, for example, and the outer shape data used for the print pass generation may be generated according to a predetermined algorithm. In this case, for example, consideration is given to using data indicated with outline i, j for the outer shape data, where $0 \leq i < N_s$ ($N_s$: maximum number of cross-sections generated at an equal interval), $0 \leq j < Nd$ (Nd: number of points of each cross-sectional data).

FIGS. 4A to 6B are views describing a process related to the acquisition of the outer shape data. Hereinafter, the printing target object 50 is referred to as work, for the sake of convenience of explanation. Furthermore, one example of the process described below is referred to as the process of the present example.

Figure 4A:
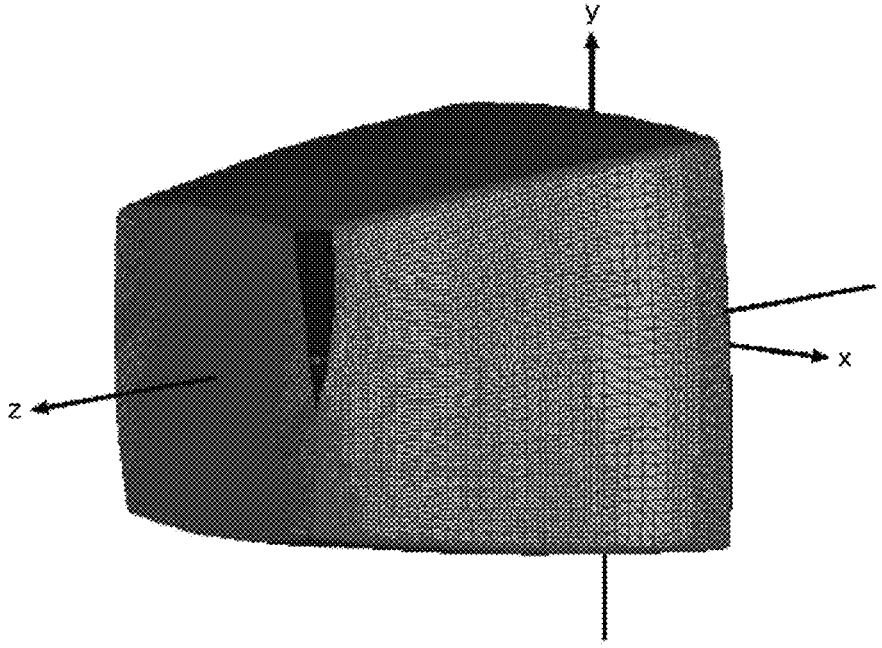
FIGS. 4A and 4B are views describing a process related to an acquisition of outer shape data.

FIG. 4A is a view showing a model of a shape (work shape) of a work, which is the printing target object, and shows one example of the shape of the work indicated with the data of STL format (STL data). In the process of generating the outer shape data, data indicating the shape of the work is first prepared. Consideration is made to using the data of widely used STL format for the data indicating the shape of the work. In this case, for example, (x, y, z) shown in the figure is handled as a coordinate system of the work. Furthermore, the data indicating the shape of the work is not limited to the data of STL format, and may be data of other format as long as the data indicates the 3D shape output from the CAD, and the like.

In this case, for example, the facts that z=0 at the bottom surface of the work, which is the surface located farthest in the work, and the outer shape of the work is defined to surround a reference point x=y=0 are considered for the restriction of the STL data. Accordingly, for example, the shape of the work can be easily and appropriately shown. Furthermore, the restriction can be eliminated by, for example, changing (improving) the calculation method.

With respect to the number of triangular elements of the STL data, a more detailed shape can be expressed by increasing the number of elements. In this case, however, it is concerned that, for example, the process may become heavy in the calculation and smoothness of the shape surface may be lost. Thus, the number of elements is preferably set appropriately according to the required precision and the like.

Figure 4B:
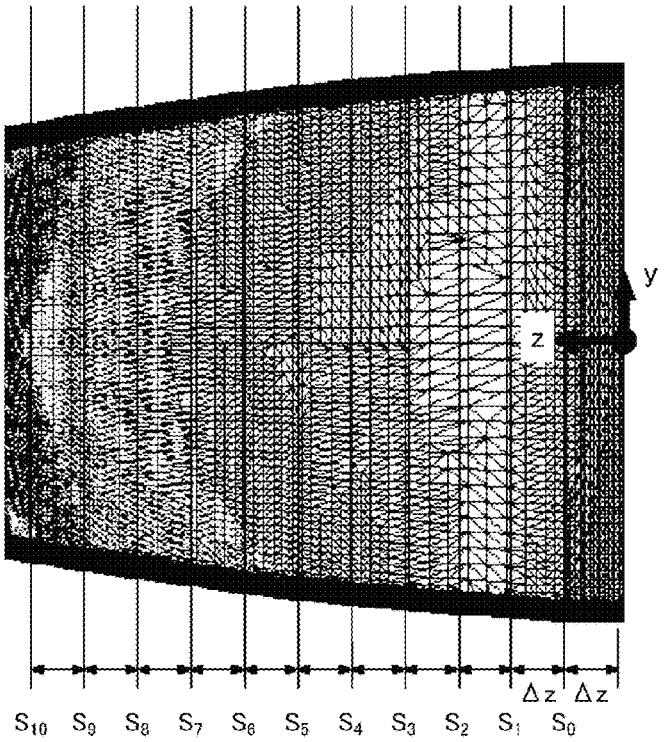

FIG. 4B shows one example of a process of forming cross-sectional data from STL data. After preparing the data (STL data, etc.) indicating the shape of the work, the process of obtaining the data (cross-sectional data) of the cross-section shape of the work is carried out based on the data indicating the shape of the work. The cross-sectional data is obtained, for example, to reduce the amount of data and to facilitate the subsequent calculation. More specifically, in the process of obtaining the cross-sectional data, the STL data indicating the shape of the work is sliced at an equal interval in the z direction to obtain the cross-sectional point group coordinate of the xy plane.

In the process of the present example, the cross-section of z=0 includes data of the bottom surface (xy plane of z=0). In this case, in order to perform the calculation without removing the relevant portion, for example, consideration is given to assuming the plane of z=Δz as a reference plane i=0 (S0), and subsequently obtaining the cross-sectional point group coordinate value at an equal interval of (S1, . . . , Sn). In this case, for example, all of the points where the three-side vector of the triangular elements of the STL data cross-intersects the z position of each cross-section are obtained for the cross-sectional point group coordinate. The data of the cross-sectional coordinate for one cross-section is indicated as ($cs_i$.x, $cs_i$.y) using an element $cs_i$ having the x, y components.

In this case, the number of elements of the cross-sectional data differs depending on the cross-sectional position. Thus, assuming the number of points in each cross-section (number of cross-sectional points) is $N_{stl}$, i becomes a number in the range of $0 \le i < N_{stl}$.

Figure 5A:
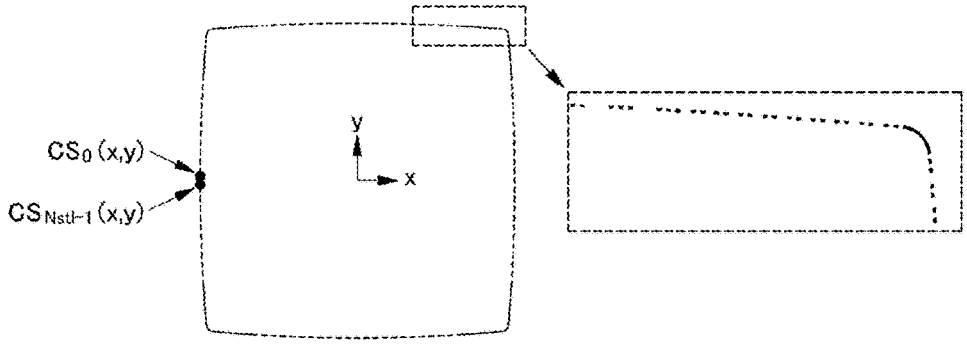
FIGS. 5A to 5C are views describing a process related to the acquisition of the outer shape data.

FIG. 5A is a view showing one example of the cross-sectional point group data obtained from the STL data, where the coordinate ($cs_i$.x, $cs_i$.y) of the point group in one cross-section is plotted. In FIG. 5A, the view on the left side shows all the points in the cross-section. Furthermore, the view on the right side is a view showing one part of the cross-section in an enlarged manner, and shows the portion surrounded with a rectangle in the figure on the left side in an enlarged manner. As illustrated, the point group coordinate includes $N_{stl}$ data. Furthermore, with respect to $N_{stl}$ data, a state sorted in a clockwise direction with an origin as a center such that a last point becomes $cs_{Nstl-1}$.x, $cs_{Nstl-1}$.y) with an arbitrary point as ($cs_0$.x, $cs_0$.y) is obtained.

As shown in an enlarged view on the right side of the figure, the interval of the cross-sectional point group obtained from the STL data may not necessarily be an equal interval due to the arrangement of the triangular element. However, in this state, the weight corresponding to the inter-point distance changes when carrying out curve approximation and the like. As a result, an unexpected noise may generate in the approximate curve. Thus, in the process of the present example, a process of replacing the point group in each cross-section to an equal interval is further carried out to carry out a smooth curve approximation next.

Figure 5B:
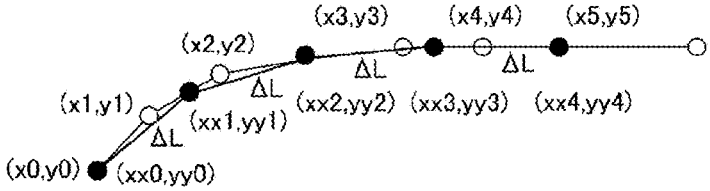

FIG. 5B is a view showing one example of an equal interval process of the point group, and shows an example of an algorithm for converting the point group obtained from the STL data to an equal interval. In this process, first with an initial position ($x_0$, $y_0$) as a starting point for starting the calculation, this is assumed as ($xx_0$, $yy_0$). A point spaced apart from such starting point by ΔL is then obtained with linear approximation. The obtained point is assumed as ($xx_1$, $yy_1$), and set as the starting point for the next calculation.

More specifically, in this calculation, according to the following procedure, a point spaced apart by ΔL is first obtained with ($x_0$, $y_0$) as the starting point, and a distance from ($xx_0$, $yy_0$) to ($x_1$, $y_1$), ($x_2$, $y_2$), . . . ($x_n$, $y_n$) is obtained, and zone numbers n, n+1 (in this case, zones 1, 2) including the ΔL is obtained. A two-point distance of two points ($x_n$, $y_n$), ($x_{n+1}$, $y_{n+1}$) indicating the zone 1 is indicated with an intervening variable t, where a coordinate of ($xx_1$, $yy_1$) can be obtained by defining t with the following equation 1 such that the distance from the starting point ($x_0$, $y_0$) becomes ΔL. Furthermore, the starting point is updated to ($xx_1$, $yy_1$), and such calculation is sequentially repeated, so that a point group row $csn_i$ lined at a substantially equal interval can be obtained.

$$x=(x_{n+1}-x_n)t+x_n$$

$$y=(y_{n+1}-y_n)t+y_n$$

$$\Delta L=\sqrt{(x-xx_0)^2+(y-yy_0)^2} \quad \text{(Equation 1)}$$

Furthermore, the xy elements of the point group row are indicated as ($csn_i$·x, $csn_i$.y) below. In this case, the number of elements of the point group row differs depending on the peripheral length of the cross-section. If the number of elements is $N_{csn}$, i is in the range of $0 \le i < N_{csn}$.

Figure 5C:
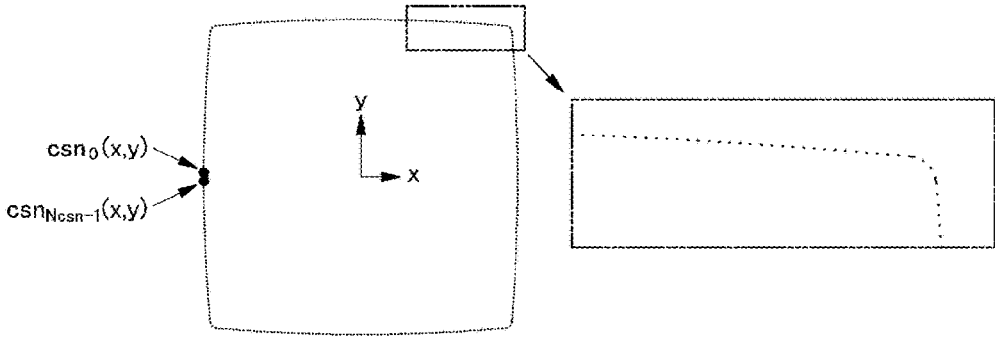

FIG. 5C is a view showing one example of a result of rearranging the point group (dot row) in the cross-section to an equal interval, and shows an example of the result of converting the point group obtained from the STL data to equal interval for one cross-section. In FIG. 5C, the view on the left side shows all the points in the cross-section. Furthermore, the view on the right side is a view showing one part of the cross-section in an enlarged manner, and shows the portion surrounded with a rectangle in the figure on the left side in an enlarged manner.

In the illustrated case, the interval ΔL of the point group data is 0.5 mm. The selection of the value of ΔL may influence the final calculation result depending on the shape. Thus, the value of ΔL is preferably set in view of, for example, the maximum curvature of the shape. In this case, for example, the value is preferably set with reference to a change (acceleration/deceleration state) in the final print pass coordinate.

Furthermore, in the process of the present example, a process of interpolating the point group data arranged at an equal interval is further carried out following the process of converting to equal interval. More specifically, in this process, the point group data $csn_i$ arranged at an equal interval is interpolated using an interpolation equation and the like to obtain a point group lined at an interval of a designated resolution (dpi), which is a designated resolution of printing.

More specifically, in this process, number of dots $N_{dotnum}$ is obtained with a peripheral length $L_{,s0}$ obtained from the point group in the $S_0$ plane as a reference length. The number of dots $N_{dotnum}$ is a number equal to the number of points Nd of the cross-section data described above. The point group data is obtained by dividing by the number of dots for all the cross-sections. This means that the resolution changes when the peripheral length is different. Therefore, in such a case, the correction is carried out while controlling the amount of ink to be landed with respect to the change in the resolution.

As an example of interpolation, a case of interpolating with a cubic expression using four points, k−1, k, k+1, k+2 in the zone k→k+1 to be obtained is shown. In this case, the (x, y) coordinate in the zone k→k+1 is expressed with the following equation 2 when the intervening variable t (0 to 1) indication is used. In such an equation, $xx_n$ and $yy_n$ respectively indicates $csn_n.x$, $csn_n.y$.

$$x=((1-t)^3xx_{k-1}+(3.0t^3-6.0t^2+4.0)xx_k+(-3.0t^3+3.0t^2+3.0t+1.0)\,xx_{k+1}+t^3xx_{k+2})/6.0$$

$$y=((1-t)^3yy_{k-1}+(3.0t^3-6.0t^2+4.0)yy_k+(-3.0t^3+3.0t^2+3.0t+1.0)yy_{k+1}+t^3yy_{k+2})/6.0 \quad \text{(Equation 2)}$$

The normal direction at a coordinate point (x, y) designated with t is obtained according to the following equation 3 from dx, dy, which are obtained by first-order differentiating the above equation. In this case, an angle Θb of the normal direction takes a positive value in the clockwise direction with the y axis as a reference. The range thereof is $0 \le \Theta b < 360$.

$$dx=(-(1-t)^2xx_{k-1}+(t^*(3.0t-4.0))xx_k+((1+3.0t)(1.0-t))\,xx_{k+1}+t^2xx_{k+2})/2.0$$

$$dy=(-(1-t)^2yy_{k-1}+(t(3.0t-4.0))yy_k+((1+3.0t)(1.0-t))\,yy_{k+1}+t^2yy_{k+2})/2.0$$

$$\Theta b=\arccos(dx/\sqrt{(dx^2+dy^2)}) \quad \text{(Equation 3)}$$

In this calculation, consideration needs to be made as being a closed curve in which xx, yy circulate. More specifically, for example, when $k<0$, and when $k>N_{csn}-1$, attention need to be paid in the handling of k.

Next, a procedure for obtaining the coordinate of the outer shape data from the csn point group with a B spline function will be described. In the following description, the outer shape data is expressed with $outline_{i,j}$. In this case, i is in the range of cross-section number ($0 \le i < N_s$), and j is in the range of point number ($0 \le j < N_{dotnum}$). Each element of the $outline_{i,j}$ is, ($outline_{i,j}.x$, $outline_{i,j}.y$, $outline_{i,j}.\Theta b$). The calculation procedure of the $outline_{i,j}$ is as described below in (1) to (5).

(1) When the cross-section number is n, the reference position of the outer shape data is ($x=0$, $y \ge 0$). This position is irrelevant to the order of the point group coordinate arranged at an equal interval. The coordinate $outline_{n,0}$ to become the reference position of the outer shape data is then obtained from the point group of ($csn_i$). In this case, first, with ($csn_0.x$, $csn_0.y$) as the starting point, a point where the coordinate (x, y) becomes ($x=0$, $y \ge 0$) is detected while interpolating the inter-point position B with the spline function. In this case, an error range of about ±1 μm is given to x, and determination is made that the reference position is realized when within the range. The calculation is then sequentially carried out while increasing t by 0.001, for example, within the t zone to calculate the position.

(2) After the coordinate $outline_{n,0}$ of the reference position is obtained, dx, dy at the relevant point are obtained to calculate Θb. Furthermore, such coordinate of the reference position is assumed as the starting point of the next calculation.

(3) With the coordinate of the reference position as the starting point, the closed curve indicated with the point group data is divided by $N_{dotnum}$ to obtain the coordinate and the Θb at each point.

(4) After the $outline_{n,j}$ coordinate at all the points is calculated, the process is terminated.

(5) This is carried out for all the cross-sections.

Figure 6A:
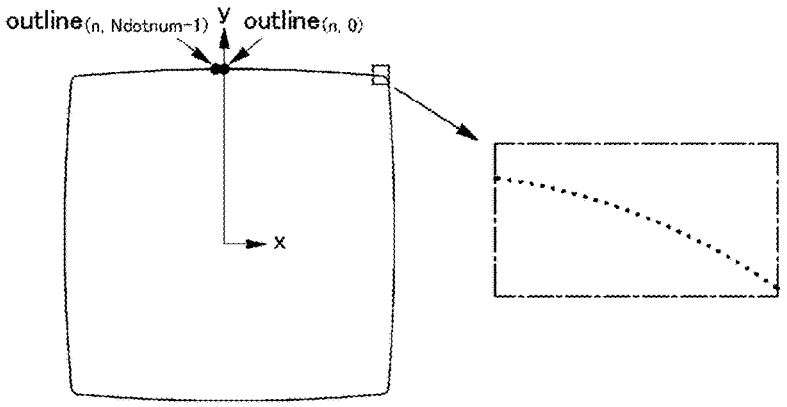
FIGS. 6A and 6B are views describing a process related to the acquisition of the outer shape data.
Figure 6B:
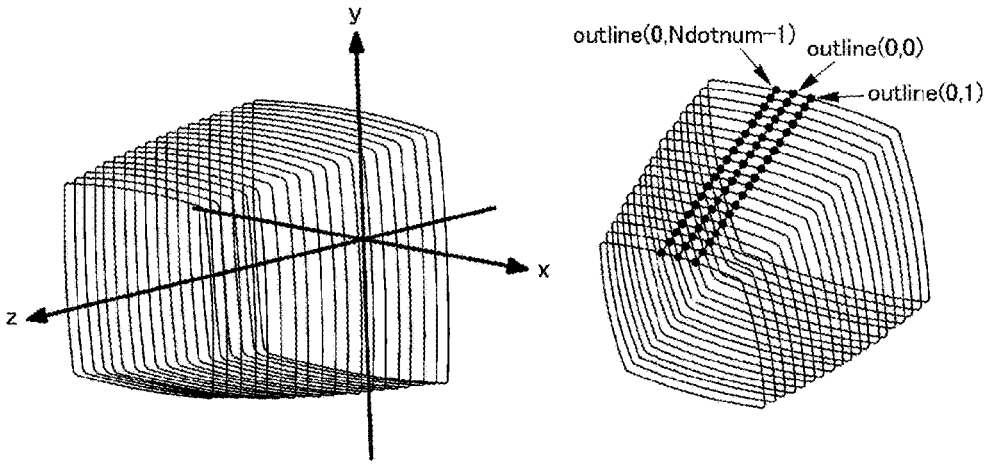

FIGS. 6A and 6B are views showing one example of the outer shape data obtained by the process of the present example, and show one example of the outer shape data obtained through the above calculation. FIG. 6A shows one example of the outer diameter data for one cross-section. In FIG. 6A, the view on the left side indicates all the points in the cross-section. Furthermore, the view on the right side is a view showing one part of the cross-section in an enlarged manner, and shows the portion surrounded with a rectangle in the figure on the left side in an enlarged manner. FIG. 6B shows one example of a result calculated for all the cross-sections.

As shown in the figure, in the process of the present example, the coordinate at the reference position of the outer shape data becomes $outline_{n,0}$, and the coordinate on the left side thereof becomes $outline_{n,N_{dotnum-1}}$. The right side of the reference position becomes $outline_{n,1}$. Furthermore, in FIG. 6B, the point group is schematically shown. When viewed planarly, such point group has a mesh form distorted accompanying the change in the outer peripheral length.

The outer diameter data is obtained in the above manner in the process of the present example. The obtained outer diameter data is mapped at the designated resolution in the main scanning direction and at an equal interval in the sub-scanning direction in a printable range in the surface of the work. After the outer diameter data is obtained, the processes of pass generation and the like for printing the actual image are further carried out based on the outer diameter data. More specifically, in the process of the present example, the calculation of the print pass coordinate is carried out following the process of obtaining the outer diameter data (acquisition of outer shape data).

Figure 7A:
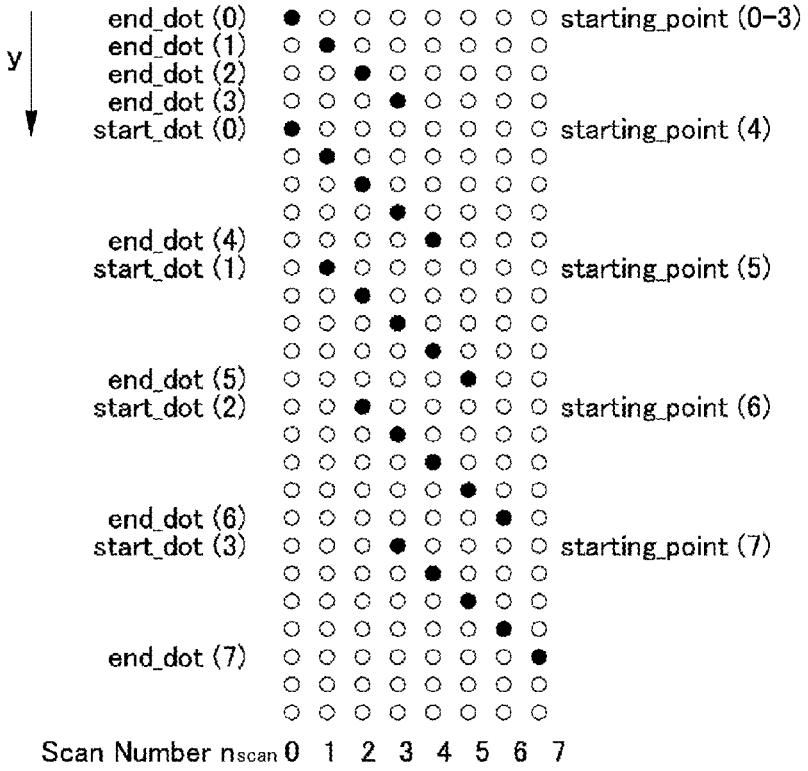
FIGS. 7A to 7C are views describing a process related to a calculation of a print pass coordinate.
Figure 7B:
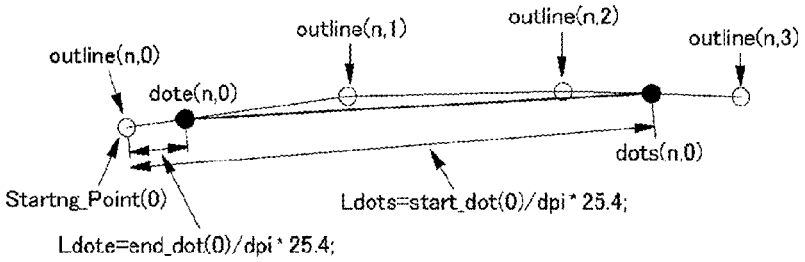
Figure 7C:
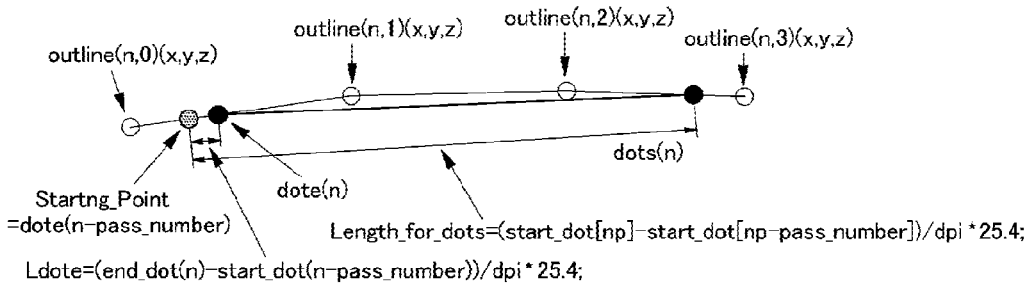

FIGS. 7A to 7C are views describing a process related to the calculation of the print pass coordinate. In the process of the present example, the print image to print on the work is defined with a two-dimensional image ($size_x$, $size_y$) of the x, y plane. In this case, a pixel coordinate at the upper left of the image is assumed as (0, 0). Hereinafter, an example of a manner of calculating the print pass coordinate (generation of print pass data) in the case of printing such image on the work expressed with the outer shape data will be described.

Furthermore, in the process of the present example, an interlace process is carried out with respect to the two-dimensional image of ($size_x$, $size_y$). In this case, when carrying out printing with the nozzle interval (nozzle pitch) in the nozzle row of the printer head as nozzle_dpi(dpi), and the printing resolution as dpi(dpi), the number of print passes $N_{pass_number}$ is defined in correspondence thereto. Moreover, the number of main scanning operations (number of scans necessary for all the scans) $N_{scan}$ necessary for printing the print image is obtained from $size_y$ in the print image and the number of passes. For each scan number $n_{scan}$, start_nozzle[$n_{scan}$] indicating a first number of the used nozzle, end _nozzle[$n_{scan}$] indicating a last number of the used nozzle, used_nozzle[$n_{scan}$] indicating a number of used nozzles, start_dot[$n_{scan}$] indicating a first y direction dot number of the print image, and end_dot[$n_{scan}$] indicating a last y direction dot number are obtained in advance.

FIG. 7A is a view showing one example of a relationship of the number of main scanning operations (number of scans) and the dot position of the image, and shows one example of a relationship of the start point and the last point for the dot position of the image for every scan. In the figure, y+ direction indicates the number of y dots of the image.

In the illustrated case, in the first main scanning operation (scan 0), the nozzle in the range of start_dot[0] to end_dot[0] is driven to discharge (printing, print) the ink. In the next main scanning operation (scan 1), the nozzle in the range of start_dot[1] to end_dot[1] is driven to discharge the ink. The start point and end point coordinate positions $dots_{n,j}$, $dote_{n,j}$ are obtained by the size_x dots of the image for every pass, which are then assumed as the print pass coordinate (printing coordinate data). In this case, n corresponds to the scan number, and j corresponds to the x dot number of the print image. The elements of dots and dote coordinates are (x, y, z, Θb).

FIGS. 7B and 7C show one example of a method for obtaining the start point coordinate $dots_{n,j}$ and the end point coordinate $dote_{n,j}$ (start point and end point coordinate calculation). In the process of the present example, each point coordinate in the scan 0 is first obtained. For example, as shown in FIG. 7B, when corresponding y=0 of the print image to $outline_{0,j}$ for the starting point starting_point of the distance calculation, the starting point coordinate becomes $outline_{0,j}$ if the scan number is smaller than $N_{passnumber}$. Furthermore, in this case, $j=dot_x$ is not necessarily required depending on the definition of the position to attach the image with respect to the surface of the work.

In the process of the present example, a distance $L_{dote}$ from the starting point starting_point to end_dot is further obtained. The distance is obtained by $L_{dote}=end_dot_0/dpi*25.4$. Next, a distance $L_{dots}$ from the starting point starting_point to start_dot is obtained. The distance is obtained by $L_{dots}=start_dot_0/dpi*25.4$.

The coordinates of dote and dots are obtained based on the outer shape data outline from the starting point starting_point. With regards to the manner of obtaining the coordinate, using dote by way of example, the zones n, n+1 of the outline including $L_{dote}$ are first obtained from the starting point starting_point. In this case, the zone including $L_{dote}$ is obtained while linear approximating the starting_point and outline coordinates. Next, with respect to the relevant zone, t that satisfies the following equation 4 is to be obtained for the coordinate value of the position where the distance from the starting point becomes $L_{dote}$ using the intervening variable t. In this case, if Θb also changes linearly, Θb is obtained from the difference in Θb of the two points and the value of t.

$$x=(\text{outline}.x_{n+1}-\text{outline}.x_n)t+\text{outline}.x_n$$

$$y=(\text{outline}.y_{n+1}-\text{outline}.y_n)t+\text{outline}.y_n$$

$$z=(\text{outline}.z_{n+1}-\text{outline}.z_n)t+\text{outline}.z_n$$

$$L=\sqrt{(x-\text{starting_point}.x)^2+(y-starting_\text{point}.y)^2+(z-starting_\text{point}.z)^2} \quad \text{(Equation 4)}$$

In this case, the calculation having the starting point as $outline_0$ is repeated until the scanning number reaches pass_number −1. This is because the starting point up to the first pass number (pass number) assumes outline0 as the starting point.

When the number of main scanning operations (number of main scanning) is greater than or equal to the pass_number, the surface of the work is assumed as a plane if the starting point is remained at outline0. Thus, when the number of main scanning becomes greater than the pass_number, the creepage distance needs to be taken into consideration with respect to the work surface. In the process of the present example, in this case, the calculation method is slightly modified. More specifically, in this case, the starting point coordinate starting_point is assumed as $dote_{n-Npass_number}$. This coordinate is a coordinate at which the printing is performed for the predetermined number of passes in the past main scanning operation (scan) and the image is completed. With such coordinate as the starting point, the distance $L_{dote}$ to the last point is obtained with the following equation 5. The distance Ldots from the starting point starting_point to the start_dot is obtained with the following equation 6. By performing such calculations for size_x for every scan, the printing coordinate necessary for one scan can be obtained in a work coordinate system, which is the coordinate system set in the work.

$$L_{dote}=(\text{end_dot}_n-\text{start_dot}[n-\text{pass_number}])/dpi*25.4 \quad \text{(Equation 5)}$$

$$L_{dots}=(\text{start_dot}_n-\text{start_dot}[n-\text{pass_number}])/dpi*25.4 \quad \text{(Equation 6)}$$

Therefore, according to the process of the present example, the print pass coordinate (printing coordinate data) necessary for printing can be acquired based on the outer shape data. Furthermore, in this case, the print pass coordinate is the data having the coordinate point on a 3D space at the first and last positions of the nozzle to use and the normal direction at each point.

Considering in a more generalized manner, the process of calculating the print pass coordinate can also be considered as, for example, a process of corresponding so as to attach the print image to the work surface. In this process, ideally, for example, the operation of printing the two-dimensional print image on a plane at a predetermined resolution (dpi) is first assumed, and the range of the used nozzle and the position of the nozzle row in the sub-scanning direction are calculated in advance for each main scanning operation (scan) to execute. Furthermore, prior to the actual printing operation on the three-dimensional work, the region on the work surface to become the target of each main scanning operation is determined in accordance with the shape of a region-to-be-printed on the work. In this case, when referring to according with the shape of the region-to-be-printed on the work, this means assuming a state in which the image is deformed in accordance with the surface shape of the region-to-be-printed. The deformation of the image is carried out by changing the pixels in the main scanning direction and the sub-scanning direction such that an optimum image is configured according to the peripheral length and the curvature of the work cross-section.

In this case, the print pass coordinate, which is the position to form the pixel (position to land the ink droplet, start point and end point coordinate position $dots_{n,j}$, $dote_{n,j}$) are calculated focusing on the nozzles at both ends of the range of the nozzle to use for each main scanning operation set in accordance with the work shape. In this case, the position is calculated for all the pixels (pixels lined in the main scanning operation) formed with the nozzles at both ends in each main scanning operation (pass). Thus, the position for the size (for the number of pixels, for the size_x dots) in the main scanning direction of the image is calculated for every scan (every pass).

In the process of the present example, the process of generation of machine coordinate is further carried out following the calculation of the print pass coordinate. This process is a process of converting the print pass coordinate (printing coordinate data) to the machine coordinate, generating the data of the print pass including the main scanning operation and the sub-scanning operation, and further adding acceleration/deceleration information to obtain the scanning coordinate data in the machine coordinate system in the three-dimensional printer 10 (see FIGS. 1A and 1B).

FIGS. 8A to 12 are views describing a process related to the generation of the machine coordinate. In the above description, the calculation method of the printing coordinate in the work coordinate system has been described. In the control of the operation of printing by the three-dimensional printer, however, the machine coordinate system, which is the coordinate system set with respect to the three-dimensional printer, needs to be used to define the operation in the apparatus. Thus, in order to actually carry out the printing with the three-dimensional printer, the printing coordinate obtained in the work coordinate system needs to be converted to the machine coordinate system.

An example of a manner of converting from the work coordinate system to the machine coordinate system will thus be described below. The conversion described below is an example of a conversion for controlling each axis of the three-dimensional printer 10 based on an average value and the like of the normal angle at $dots_{n,j}$, $dote_{n,j}$ described above.

As also described above, the machine coordinate system of the three-dimensional printer that performs the process of the present example to carry out printing is configured by six axes of direct acting three axes of X, Y, Z and the rotating three axes of A, B, C. Such coordinate system is simply referred to as machine coordinate system below. The position of each axis in the machine coordinate system is determined from the nozzle row position of when printing on the work surface.

When obtaining the coordinate of each axis, the handling of the work coordinate is indicated with x, y, z. This coordinate does not correspond to the X, Y, Z of the machine coordinate system. These relationships will be described later. The Θa, Θb, Θc axes for rotating the work coordinate correspond to the A, B, C axes of the machine coordinate system. The directions of x, y, z are maintained as is independent from the rotation of the A, B, C axes.

Figure 8A:
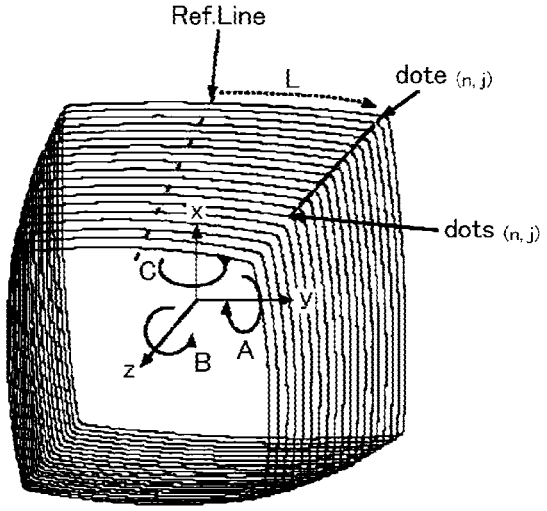
FIGS. 8A to 8C are views describing a process related to a generation of a machine coordinate.

FIG. 8A is a view showing one example of a relationship of the work shape and the print nozzle row, and schematically shows the state of the nozzle row with which printing is to be carried out on the work surface. In this case, the print nozzle row is, for example, the nozzle row that is to carry out printing on the work surface. Furthermore, the print nozzle row can also be considered as, for example, an arrangement of landing points (printing target points) set as positions where the ink is to be landed by the nozzle row of the printer head.

In the figure, the work shape is indicated with a cross-sectional line drawn at an equal interval in the z direction. A reference line (Ref. Line) of the work shape is assumed as a printing start position on the work. Furthermore, when carrying out printing with the nozzle row linearly arranged from a point spaced apart by the distance L from the reference line, the start point position $dots_{n,j}$ and the end point position $dote_{n,j}$ of the nozzle are already obtained, where the scan number is assumed as n and the print dot number is assumed as j.

Furthermore, in this case, the coordinate rotation of each axis of A, B, C is carried out based on the start point coordinate and the end point coordinate of the nozzle row. In the process of the present example, the procedure of calculation is carried out in the order of B axis rotation, C axis rotation, and A axis rotation. Thereafter, X, Y, Z of the machine coordinate system are defined from the defined x, y, z coordinate positions. Moreover, the relationship of the work surface and the nozzle row position is repeatedly obtained in the main scanning direction to realize a series of main scanning operations. Such specific calculations are carried out in the following manner.

Figure 8B:
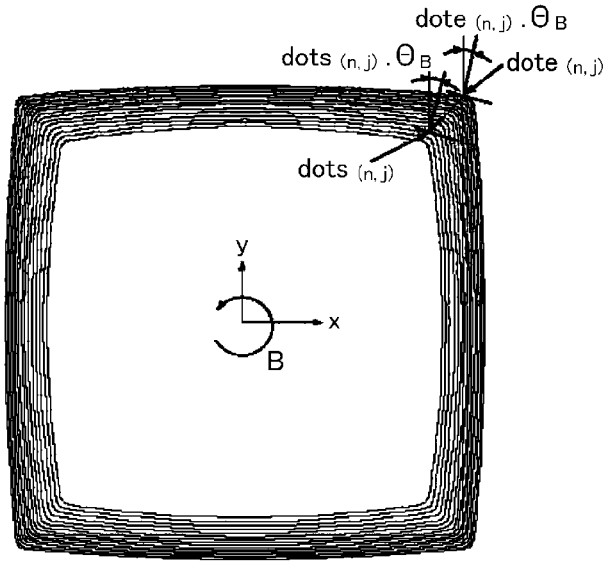

FIG. 8B is a view describing the calculation method of the B axis rotation angle, and shows one example of a state in which the work is projected onto the xy plane. As mentioned above, the coordinate rotation is carried out first from the B axis. In the process of the present example, the B axis rotation is an operation for coinciding the vertical direction of the nozzle row and the normal direction of the work surface. More specifically, in the B axis rotation, an angle $\Theta_B$ formed by the normal component at the start point position and the end point position and the y axis is first obtained on a line connecting two points of the start point position $dots_{n,j}$ and the end point position $dote_{n,j}$ of the nozzle. In this case, the normal angles $dots_{n,j}.\Theta_B$, $dote_{n,j}.\Theta_B$ at the start point and the end point are already obtained. Thus, the average value thereof $\Theta_B=(dots_{n,j}.\Theta_B+dote_{n,j}.\Theta_B)/2$ is adopted for the normal angle with respect to the relevant nozzle row.

The average of the two points is adopted instead of adopting a specific one of the normal angles at the start point and the end point because there is a possibility that the normal directions at the start point and the end point positions may differ. The designated range of the B axis angle is the range of $0 \leq \Theta_B < 360(2\pi)$. The relevant direction assumes the counterclockwise direction as positive with y+axis as 0(deg).

Figure 8C:
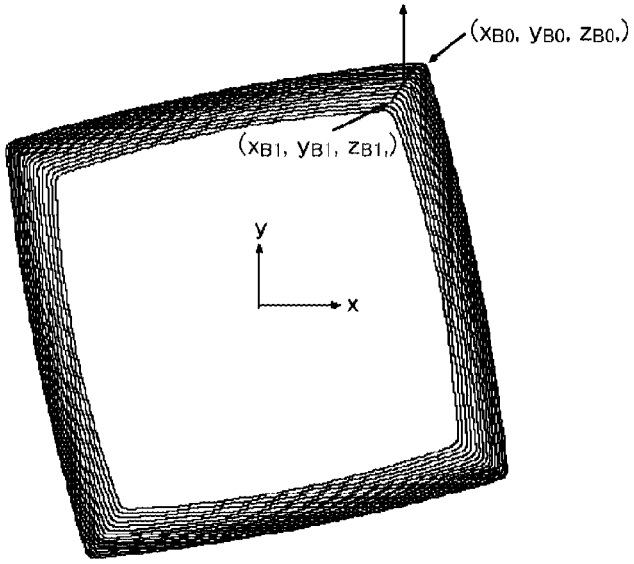

FIG. 8C is a view showing one example of a state after the B axis rotation, and shows a position relationship of the work shape projected onto the XY plane after the B axis rotation and the nozzle row. As a result of rotating the B axis, the average normal direction of the nozzle row coincides with the y axis. Furthermore, hereinafter, the start point and end point coordinates (start point and end point coordinates of the nozzle row after the B axis rotation) obtained as a result of rotating about the B axis are hereinafter assumed as $(x_{B0}, y_{B0}, z_{B0})$, $(x_{B1}, y_{B1}, z_{B1})$. As described above, in the process of the present example, the calculation for the C axis rotation is carried out following the B axis rotation.

Figure 9A:
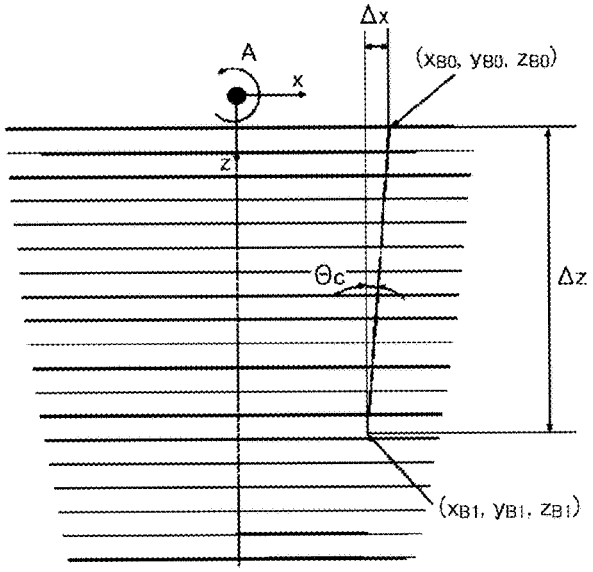
FIGS. 9A and 9B are views describing a process related to the generation of the machine coordinate.

FIG. 9A is a view showing one example of a state before the C axis rotation, and shows a state of the work projected onto the xz plane after the B axis rotation and the nozzle row. In the process of the present example, the C axis is an axis (axis having y axis as the rotating center with respect to the xz plane) that rotates with the y axis as the center in the xz plane.

More specifically, in the C axis rotation, the C axis rotation angle $\Theta_C$ is obtained from the start point and end point coordinates $(x_{B0}, y_{B0}, z_{B0})$, $(x_{B1}, y_{B1}, z_{B1})$ of the nozzle row on the xz plane with $\Theta c=\arccos(\Delta z/\sqrt{(\Delta x^2+\Delta z^2)})=\arccos(z_{b1}-z_{b0})/\sqrt{((x_{b1}-x_{b0})^2+(z_{b1}-z_{b0})^2)}$. As shown in the figure, in the rotating direction, the counterclockwise direction is assumed as positive. Furthermore, the direction of Θc is determined with the sign of Δx.

Figure 9B:
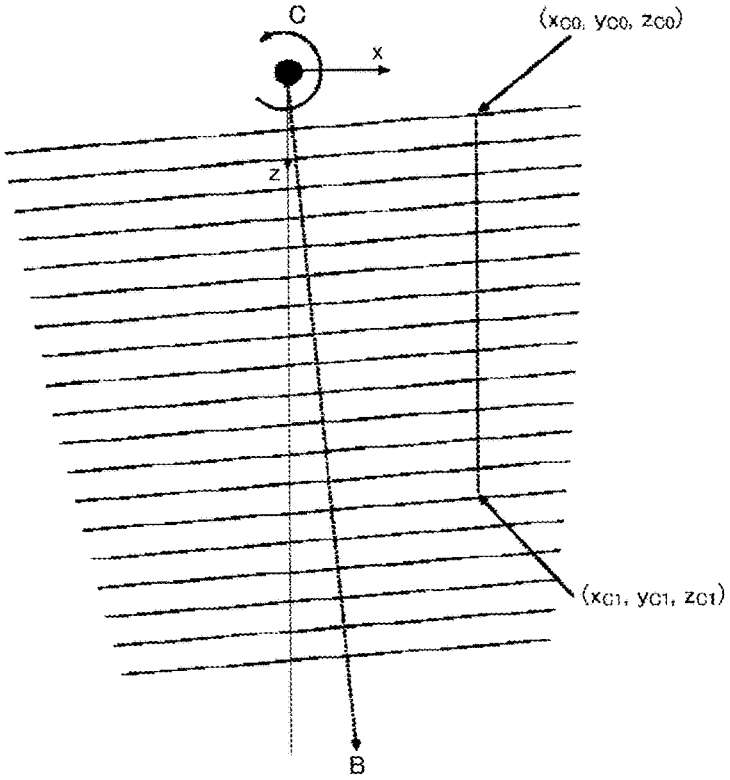

FIG. 9B is a view showing one example of a state after the C axis rotation. After the C axis rotation, the print nozzle row becomes parallel to the z axis. As a result, it can coincide with the nozzle row of the printer head installed parallel to a mechanistic X axis (z axis in shape). Hereinafter, the start point and end point coordinates of the nozzle row after the C axis rotation are assumed as $(x_{C0}, y_{C0}, z_{C0})$, $(x_{C1}, y_{C1}, z_{C1})$. Furthermore, as described above, in the process of the present example, the calculation for the A axis rotation is carried out following the C axis rotation.

Figure 10A:
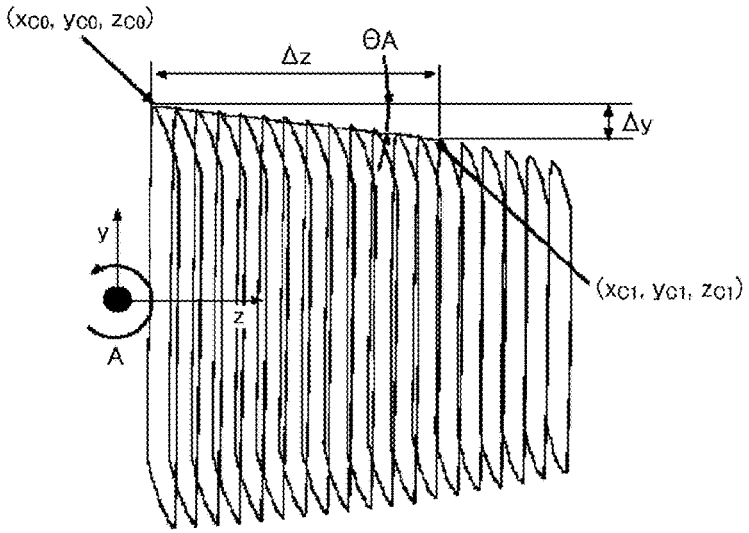
FIGS. 10A and 10B are views describing a process related to the generation of the machine coordinate.

FIG. 10A is a view showing one example of a state before the A axis rotation, and shows a state of the work projected onto the xz plane after the C axis rotation and the nozzle row. In the process of the present example, the A axis is an axis that rotates with the x axis as the center in the yz plane.

More specifically, in the A axis rotation, the A axis rotation angle $\Theta_A$ is obtained with $\Theta_A=\arccos(\Delta z/\sqrt{(\Delta y^2+\Delta z^2)})=\text{arcoss}((z_{C1}-z_{C0})/\sqrt{((y_{C1}-y_{C0})^2+(z_{C1}-z_{C0})^2)})$. As shown in the figure, in the rotating direction, the counterclockwise direction is assumed as positive. The direction of $\Theta_A$ is determined with the sign of Δy.

Figure 10B:
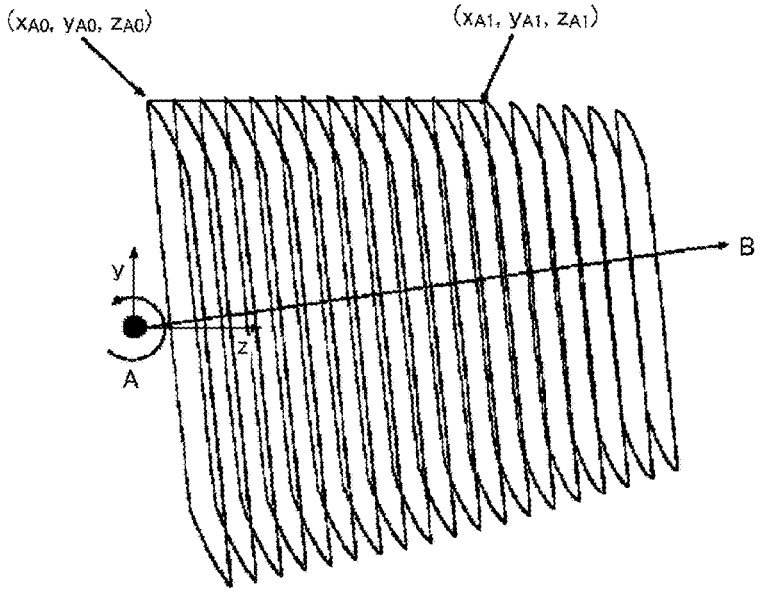

FIG. 10B is a view showing one example of a state after the A axis rotation. After the A axis rotation, the print nozzle row becomes parallel to the z axis. Hereinafter, the start point and end point coordinates of the nozzle row (print nozzle row) after the A axis rotation are assumed as ($x_{A0}$, $y_{A0}$, $z_{A0}$), ($x_{A1}$, $y_{A1}$, $z_{A1}$).

Figure 11A:
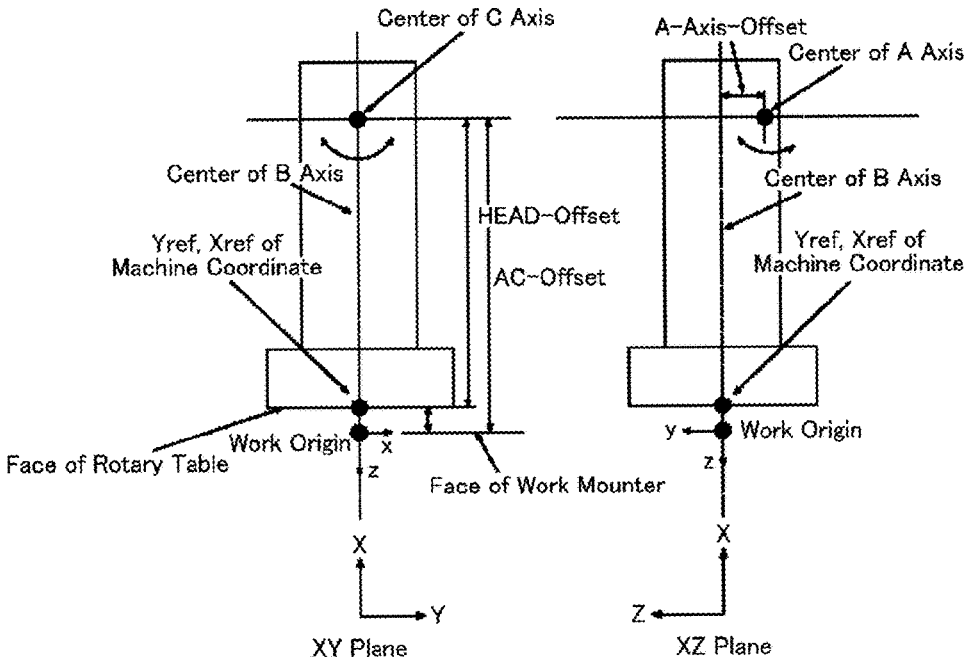
FIGS. 11A and 11B are views describing a process related to the generation of the machine coordinate.

In the configuration of the actual three-dimensional printer, a predetermined offset sometimes occurs in the position relationship of the ABC axes. In this case, for example, consideration is given to converting the work coordinate system calculated in the past to the machine coordinate by further taking into consideration the offset in the ABC axes. FIG. 11A is a view showing one example of an offset in the ABC axes.

Figure 11B:
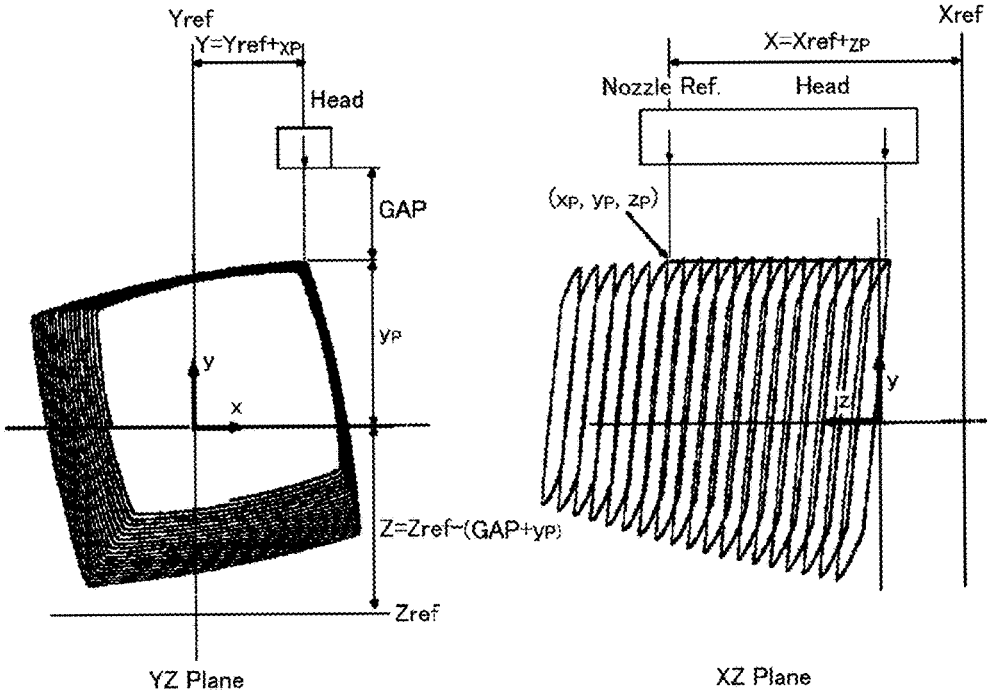

FIG. 11B shows one example of a relationship of the machine coordinate system and the work coordinate system. In FIG. 11B, the view on the left side indicates the YZ plane in the machine coordinate system. The view on the right side indicates the XZ plane in the machine coordinate system. In the process of the present example, the end point coordinates of the print nozzle row $x_{A1}$, $y_{A1}$, $z_{A1}$ are assumed as $x_P$, $y_P$, $z_P$, and a point coinciding with the yz plane of the work coordinate in the YZ plane for the nozzle center of the printer head with respect to the relevant coordinate is defined as a reference point (Yref=0). Thus, movement is merely made to the position of $Y=Yref+x_P$ to make the nozzle center coincide with the print nozzle row.

Taking the X axis into consideration, the reference position of the nozzle in the printer head is merely made to coincide with $z_p$ of the work coordinate system. In this case, since $z_P$ is already calculated in view of the offset in the rotation mechanism of the ABC axes and the offset in the work attachment jig, $X=z_P$ is to be obtained. The Z axis merely needs to be determined in view of $y_P$ and the gap distance of the printer head and the work surface from the Z reference surface. In this case, if the Zref point is defined at a certain value, it can be obtained with $Z=Zref-(GAP+y_P)$. Furthermore, as described above, if moved while controlling the respective drive axis to each position of the X, Y, Z and the A, B, C coordinates of the calculated work coordinate system, the head can be moved to immediately above the print nozzle row of the target work and the printing can be performed.

Figure 12:
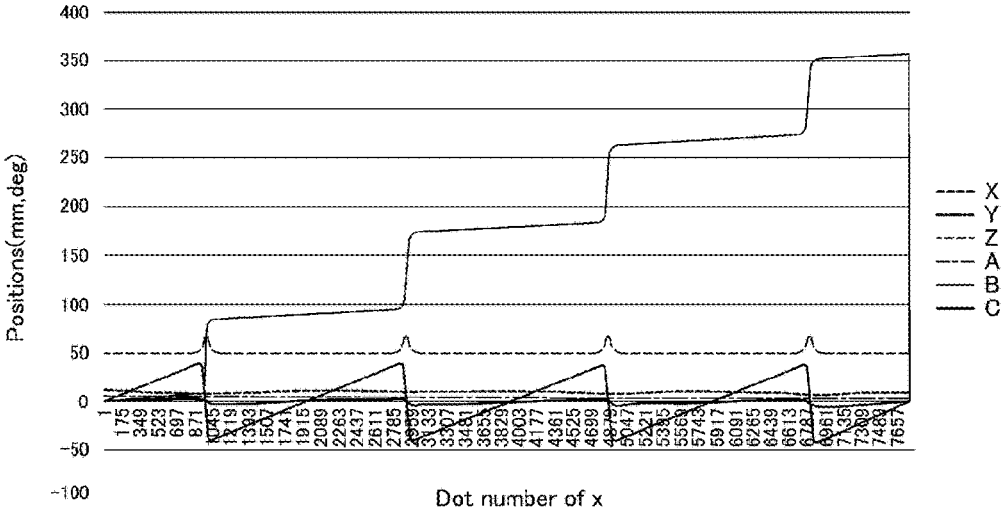
FIG. 12 is a view showing one example of a calculation result of a process related to the generation of the machine coordinate.

FIG. 12 is a view showing one example of a calculation result for the process related to the generation of the machine coordinate, and shows the amount of one main scanning operation (amount of one scan) for the change in the X, Y, Z, A, B, C coordinates calculated by the above calculation with respect to one example of the result calculated as above. In the figure, the horizontal axis indicates the dot number in the x direction of the print image. With respect to the XYZ axes, the vertical axis indicates the distance (mm). With respect to the ABC axes, the vertical axis indicates the angle (deg). When perfoiuiing printing on the work surface, the necessary ink is to be discharged from the nozzle based on the print data indicating the print image while moving to the relevant axial position.

Accordingly, the process of the generation of the machine coordinate can be appropriately carried out. Considering in a more generalized manner, for example, the process of the generation of the machine coordinate can also be considered as a process of calculating the machine coordinate for adjusting the position of the work in correspondence with the print pass coordinate. In this case, for the adjustment of the position of the work, for example, the position (orientation) of the work is adjusted so as to match the normal direction of the work surface with the vertical direction (discharging direction of ink droplet) as much as possible for every scan number n and the print dot number j. Furthermore, in this case, more specifically, the adjustment of the rotation angle is carried out using the average value of the normal angles with respect to both ends (start point position, end point position) of the used nozzle.

Now, the process of image correction will be described. As already described above, when carrying out printing with respect to the three-dimensional work with the three-dimensional printer, the lowering in the quality of the image to be printed sometimes becomes a problem due to the constraint on the configuration of the nozzle row.

More specifically, in the above description, the coordinate generation method for performing printing on the work or the 3D object has been described. In the coordinate generation, the nozzle row of the printer head configured with a straight line is calculated in a form of connecting two points on the work. The peripheral length of the work may change with respect to the z direction of the work coordinate system. With regards to this point, for example, if such change is uniform, an appropriate printing result can be obtained by simply carrying out a concentration correction with the change in effective dpi by performing the printing using the machine coordinate data described above. However, if the change in the peripheral length with respect to the z direction is not uniform, a landing shift that cannot be handled with only the concentration correction corresponding to the change in effective dpi may occur.

To this, the inventor of the present application has discovered that the influence on the image quality can be suppressed by carrying out correction corresponding to the influence of the constraint on the configuration of the nozzle row. More specifically, in the process of setting a printing target point, which is a position where the ink is to be discharged from each nozzle in the nozzle row, on the surface of the printing target object, consideration is given to calculating an ideal landing point, which is a landing point calculated without limiting a condition that the nozzles are linearly lined in the nozzle row, and an actual landing point, which is a landing point calculated under a condition that a plurality of nozzles are linearly lined in the nozzle row, carrying out the correction corresponding to a shift amount in the positions of both landing points, and setting a printing target point. The inventor has thereby discovered that printing of higher quality can be carried out.

Hereinafter, a mechanism in which the landing shift is produced and the image correction for correcting the same will be described. FIGS. 13A to 15B are views describing the process of the image correction.

Figure 13A:
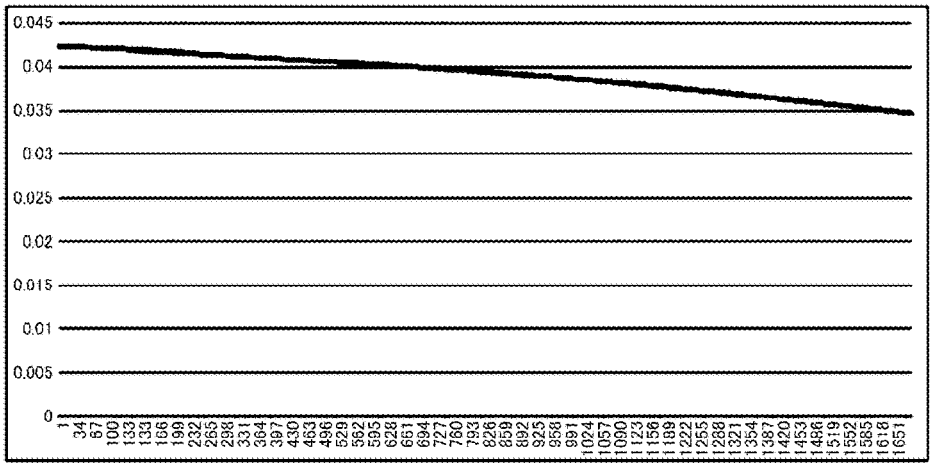
FIGS. 13A to 13C are views describing a process of image correction.

FIG. 13A is a view showing one example of the change in an inter-dot distance by the peripheral length, and shows the change in the dot interval in relation to the y component of the print image. In the figure, the vertical axis indicates the dot interval. The vertical axis indicates a value corresponding to the dot number in the y direction of the image. The illustrated data shows a case of printing on the work shaped surface described above with the resolution of printing as 600 dpi. In this case, the dot interval is non-linearly changed with respect to the y direction of the print image, as shown in the figure. The nonlinear difference indicates that the peripheral length of the work is not uniformly changed. This also indicates that the mesh obtained with the outer shape data outline is distorted when viewed from a standpoint of uniformity of dot interval.

Figure 13B:
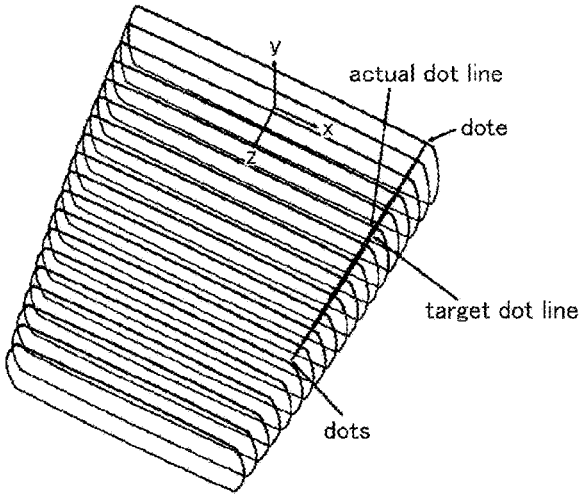

FIG. 13B shows one example of the change in the actual landing point (actual dot line) and the ideal landing point (target dot line). In this case, the actual landing point and the ideal landing point are both coordinates calculated by interpolation using the outer shape data for the position of the pixel to be formed by the nozzle other than the nozzles at both ends of the range of the nozzle to use. The actual landing point is the landing point (landing point on the work) of the ink that can be discharged from the nozzle in the linear nozzle row. More specifically, in the process of the present example, the actual landing point is the point group coordinate calculated by the used nozzle position by linearly interpolating the dots, dote in the printing coordinate. The ideal landing point is the ideal landing point of the ink discharged from the nozzle in the nozzle row. More specifically, in the process of the present example, the ideal landing point is the point group coordinate calculated so that the landing points are lined at an equal interval along the outer peripheral curve corresponding to each cross-section of the work. The ideal landing point may be the point group coordinate calculated so that the landing points of the ink for every y dot are at an equal interval along the outer shape data with respect to the x direction.

As described above, when the inter-dot distance is changed with respect to the z direction by the change in the peripheral length and the changing manner is not uniform, the ideal landing point curves on the work surface. Thus, the landing error occurs if printing is carried out with the nozzle row in which dots, dote is interpolated with a straight line. In this case, when referring to carrying out interpolation with a straight line, this more specifically means interpolating the positions of the linear nozzle row calculated from dots, dote obtained in correspondence with the sub-scanning operation, and obtaining the actual landing point of the intermediate nozzle under the condition that the range of the nozzle to use is defined in correspondence with the feeding amount in the sub-scanning direction.

Figure 13C:
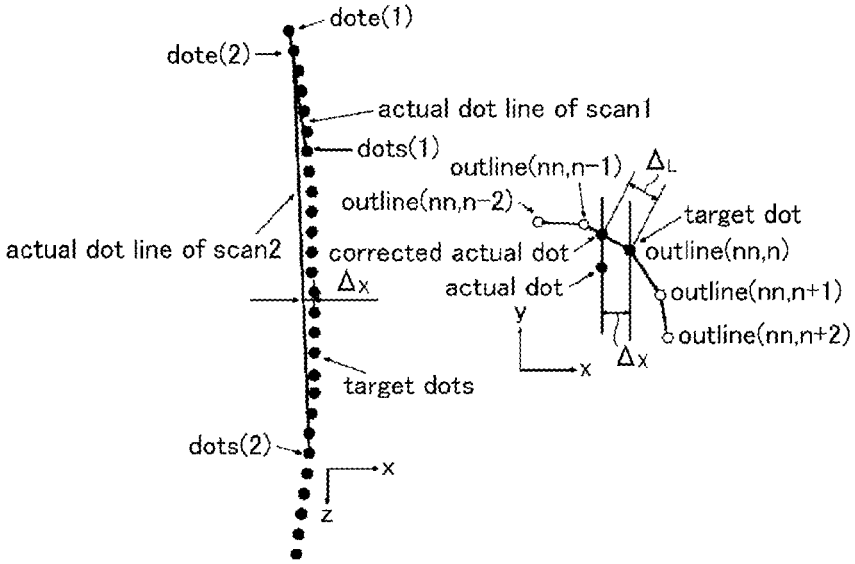

FIG. 13C schematically shows a mechanism of occurrence of a landing error. In FIG. 13C, the view on the left side shows the xz plane in the work coordinate system. The view on the right side shows the xy plane in the work coordinate system. The point group shown in the figure is the ideal landing point (target dot line) drawn by interpolating the dots, dote of the printing coordinate along the outer shape data (outline data).

Here, for example, if dots(1) and dote(1) are connected with a straight line and the ink is discharged onto such straight line in the main scanning operation shown as scan1 in the figure, the ideal landing point and the actual landing point (actual dot line) substantially coincide with each other. The main scanning operation shown as scan2 in the figure is when carrying out printing using greater number of nozzles between dots(2), dote(2). In this case, a distance Δx between the actual landing point and the ideal landing point increases compared to the case of scan 1 as dots(2), dote(2) are approximated with a longer straight line.

On the other hand, to reduce such influence, for example, improvement can be achieved by reducing the number of the used nozzles in each main scanning operation, and repeatedly carrying out printing. Such method, however, is not practical as the printing time becomes long. Thus, it is desirable to reduce the influence through other methods.

Figure 14A:
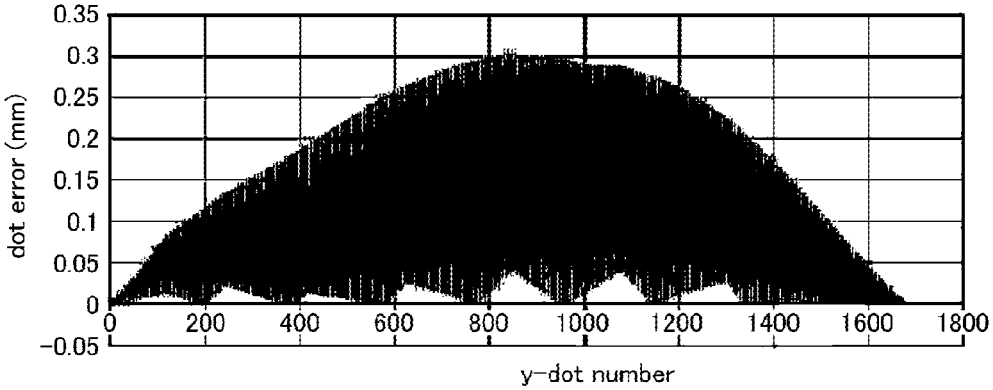
FIGS. 14A and 14B are views describing a process of image correction.

The landing error is small in the vicinity of dots, dote, and large in other regions. FIG. 14A shows one example of a change in the landing error (dot landing error) at the printing position. In the figure, the horizontal axis indicates the dot number (z direction of the work coordinate system) in the y direction of the image. The vertical axis indicates the error amount. As shown in the figure, it can be seen that the landing error becomes small in the vicinity of dots, dote in the printing coordinate. In other places, increase and decrease of the landing error are periodically repeated for every scanning (every main scanning operation).

Figure 14B:
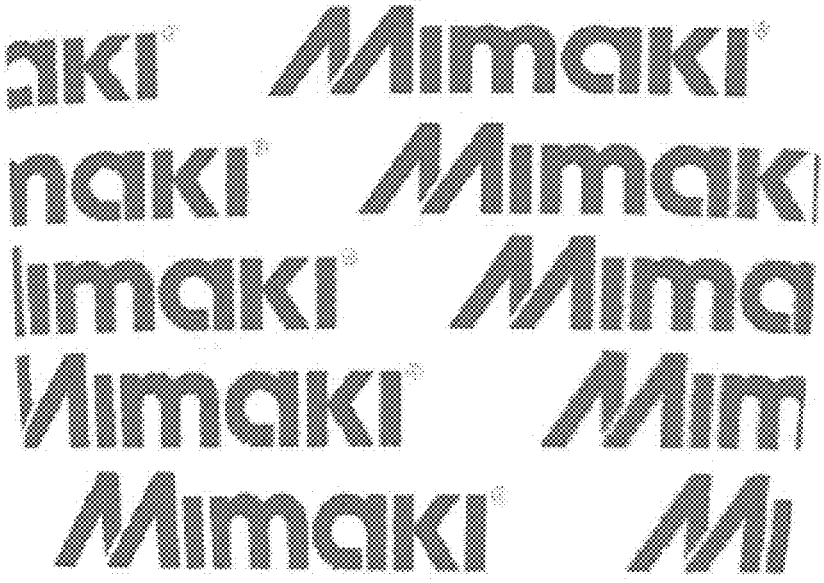

FIG. 14B is a view showing one example of a result of carrying out printing while such landing error is occurring, and shows the printing result obtained by a simulation for when the printing is carried out without performing the image correction described below. In the printing result, a satisfactory printing result is obtained for the central part of the image, that is, the portion where the curvature of the ideal landing point is small. However, the influence of the curvature becomes greater toward both ends. Furthermore, the landing shift in the main scanning direction that periodically appears every time the sub-scanning operation is carried out also occurs. At the upper part and the lower part of the screen, the number of used nozzles decreases, and thus the landing error becomes small compared to the vicinity of the central part.

On the contrary, in the process of the present example, the process of image correction is carried out, as also described above. Hereinafter, the image correction performed in the process of the present example will be described in more detail.

As also described above, the landing error (distance) is the distance between the ideal landing point and the actual landing point. More specifically, for example, the landing error (distance) calculated on the xz plane is Δx in the figure shown on the left side of FIG. 13C. When viewed in the figure of the xy plane shown on the right side of FIG. 13C, the actual landing point is not necessarily calculated on the work surface. Thus, in this case, the position of landing on the work surface is assumed as the actual landing point, and the distance ΔL with the ideal landing point in this case is assumed as the actual landing error. Furthermore, this calculation obtains an intersection with the outer shape data in the perpendicular direction from the actual landing point (actual dot) obtained by interpolating with a straight line and calculates the ΔL with the intersection as the actual landing point (corrected actual dot). Moreover, the landing error (distance) of each dot can be more appropriately calculated by carrying out such calculation.

The outer shape data (outline) in the figure does not necessarily exist in the cross-section of the actual landing point. Thus, the outline is a point group obtained by interpolation so that the z coordinate of the actual landing point is the cross-section. The calculation method described above can be practically obtained from, for example, the result of carrying out only the rotation of the B axis. More precisely, for example, the method is preferably obtained including the rotation of the AC axes.

The image correction can be carried out so as to counteract the influence of the landing error by calculating the landing error in such a manner. When referring to carrying out the image correction so as to counteract the influence of the landing error, for example, this means calculating the pixel information corresponding to the actual landing point from the information in the vicinity of the pixel of the original image corresponding to the actual landing point for the print image.

Figure 15A:
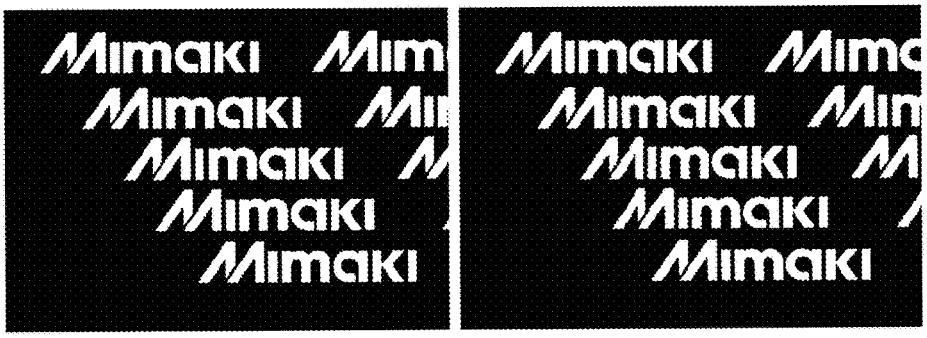
FIGS. 15A and 15B are views describing a process of image correction.

FIG. 15A shows one example of a result of correcting the image based on the landing error calculated in the above manner. In FIG. 15A, the view on the left side shows the image before the correction. The view on the right side shows the image after the correction. In the illustrated case, the image correction is carried out through a method for converting a pixel of interest to color information of the correction pixel spaced apart by the landing error distance.

In a more specific process of image correction, the original image before the correction is defined with the dot interval (dpi) of an equal interval, whereas the dot interval (dpi) changes by the peripheral length in the work form to actually be the printing target. Thus, the position of the correction pixel needs to be obtained based on the landing error and the value of the actual dot interval (dpi). The correction pixel is not necessarily located at a place coinciding with the actual pixel. Thus, in the illustrated case, two pixel positions having the correction pixel in between in the x direction of the image are obtained, and the color information of the corrected image is interpolated and obtained through linear calculation. More precisely, for example, the correction is preferably carried out for the z direction of the work coordinate system and the y direction of the image, that is, not only the main scanning direction but also in the sub-scanning direction, and the like in the printing operation.

Looking at the result of the image correction, it can be seen that the correction amount is increased at the central part of the image in the y direction and the correction amount is reduced at both upper and lower ends so as to match the tendency of the landing error shown in FIG. 14B. In the present figure, not all the print information are displayed, but a result that the correction becomes stronger even in curved areas such as the vicinity of the ideal landing point where the landing error becomes large can be confirmed.

Figure 15B:
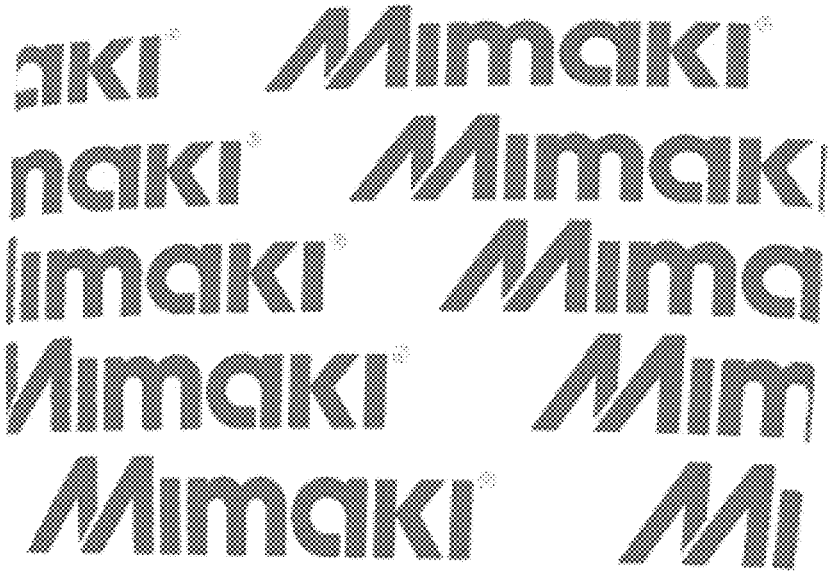

FIG. 15B is a view showing a result of carrying out printing using the corrected image, and shows the print result obtained by a simulation for when the image correction described above is performed and the printing is carried out. As shown in the figure, the landing error is entirely corrected, and a satisfactory printing result can be obtained.

A high quality printing can be more appropriately carried out with respect to the three-dimensional work by carrying out the above image correction. Next, supplementary explanation and the like are made for the image correction carried out in the process of the present example.

The image correction carried out in the process of the present example can be considered as, for example, a process of obtaining the actual landing point and the ideal landing point from the print pass coordinate (printing coordinate data), and correcting the original image according to the difference in the landing distance. The image correction can also be considered as, for example, a process of correcting the shift in the landing point that occurs when the change in the peripheral length of the work is not uniform.

More specifically, as also described above, when the change in the length of the peripheral length of the work with respect to the z direction is not uniform, the mesh (arrangement of pixels) obtained with the outer diameter data is curved when viewed planarly from the standpoint of uniformity of the dot interval. The landing shift occurs when the printing is carried out using the ink jet head including the nozzle row in which the plurality of nozzles are linearly arranged with respect to the curved point group. Furthermore, the reason why such landing shift occurs can be assumed to be because, for example, when the linear nozzle row is used, the position where the ink droplet is to be landed with the intermediate nozzle other than the nozzles at both ends is calculated through interpolation by a straight line such as, for example, when calculating the actual landing point. In this case, if the change in the peripheral length of the work is not uniform, the arrangement of the ideal landing point corresponding to each nozzle (all used nozzles including nozzles other than at both ends) of the nozzle row becomes curved. As a result, the landing shift (landing error) occurs by the difference produced between the two.

In the process of the present example, on the other hand, the influence of the landing shift can be suppressed by correcting the print image in accordance with the shift produced between the ideal landing point and the actual landing point, as described above. Furthermore, a high quality printing of high precision can be more appropriately carried out even if the change in the peripheral length of the work is not uniform.

Furthermore, the image process in the process of the present example can be considered as, for example, being carried out by the control device 24 (see FIGS. 1A and 1B) in the three-dimensional printer 10 (see FIGS. 1A and 1B). In this case, the control device 24 operates as, for example, the print control device, and carries out a process of setting the printing target point, which is the position where the ink is to be discharged from each nozzle, on the surface of the printing target object 50. For such a process, at least an ideal landing point calculation process, an actual landing point calculation process, and a printing target point setting process are carried out.

In this case, the ideal landing point calculation process is a process of calculating the ideal landing point. Furthermore, in the ideal landing point calculation process, the control device 24, for example, calculates the ideal landing point based on the shape of the surface of the work or the printing target object without limiting the condition that the plurality of nozzles are linearly lined in the nozzle row. More specifically, as described in relation to FIGS. 1A and 1B and the like, in the three-dimensional printer 10 of the present example, the printing target object 50 (see FIGS. 1A and 1B), which is the work, is rotatably held by the target object holding device 18 (see FIGS. 1A and 1B). In this configuration, for example, when a line (curve, etc.) that goes around the surface of the work once along the position where a plane perpendicular to the rotating axis of the rotation and the surface of the work intersect is defined as a cross-section outer peripheral line, the control device 24 calculates a plurality of ideal landing points lined along the cross-section outer peripheral line so as to line at an equal interval along the cross-section outer peripheral line in the ideal landing point calculation process.

The actual landing point calculation process is a process of calculating the actual landing point. In the actual landing point calculation process, the control device 24, for example, calculates the actual landing point based on the shape of the surface of the work under the condition that the plurality of nozzles are linearly lined in the nozzle row. The printing target point setting process is a process of setting the printing target point on the surface of the work. In the printing target point setting process, the control device 24 sets the printing target point with respect to each position based on the ideal landing point and the actual landing point corresponding to each position on the surface of the work. More specifically, in this process, when the positions are shifted between the ideal landing point and the actual landing point corresponding to the same position on the surface of the work, the control device 24 carries out the correction corresponding to the shift amount of the position to set the printing target point.

According to such configuration, for example, the correction corresponding to the shift amount of the position can be appropriately carried out even when the shift in position occurs between the ideal landing point and the actual landing point. Furthermore, for example, the quality of the image to be printed thus can be appropriately prevented from being influenced by the influence of the configuration of the nozzle row, and high quality printing can be carried out.

A case in which the positions are shifted between the ideal landing point and the actual landing point may be, for example, a case in which the positions of the landing points are shifted beyond the acceptable amount set in advance according to the desired precision and the like of the printing. When the positions are not shifted between the ideal landing point and the actual landing point, either one of the actual landing point or the ideal landing point may be set as the printing target point.

In the process of the present example, more specifically, the print image, which is the original image, is corrected for such correction. In this case, for example, the control device 24 generates a corrected image in which the print image is corrected according to the shift amount in the positions between the ideal landing point and the actual landing point in the printing target point setting process. This correction can also be considered as, for example, a process of distorting the mesh in accordance with the shift amount for the mesh-like data indicating the printing target point. At the time of executing the printing, the control device 24 carries out the control of discharging of the ink from the printer head 14 (see FIGS. 1A and 1B) so as to print the corrected image.

Furthermore, in the printing target point setting process, a distance between the ideal landing point and the actual landing point along the surface of the work is preferably used for the shift amount to use for the correction when the positions are shifted between the ideal landing point and the actual landing point. According to such configuration, for example, the influence of the landing shift can be more reliably reduced. Consideration is also given to using a distance connecting the ideal landing point and the actual landing point with a straight line without lying along the surface of the work, for example, for the shift amount used for the correction. According to such configuration, for example, the correction can be carried out with a simpler calculation.

In the printing target point setting process, the control device 24, for example, sets a nozzle row correspondence line, which is a line extending on the surface of the printing target object so as to overlap, when seen from the printer head 14 side, the line connecting the nozzles at both ends in the nozzle row. The correction is carried out so that the landing point of the ink discharged from the nozzles other than the nozzles at both ends in the nozzle row lies on the nozzle row correspondence line, and then the printing target point is set.

At the time of the operation of printing by the three-dimensional printer 10, for example, consideration is given to using only some nozzles in the nozzle row of the printer head 14 according to the print image, the shape of the work, and the like. In this case, for example, each process described above may be carried out assuming the arrangement of the nozzles to use as the substantive nozzle row.

In the above description, the method for suppressing the influence of the landing shift by correcting the print image has been mainly described. However, the correction for suppressing the influence of the landing shift is not limited to the correction of the print image, and for example, consideration is also give to carrying out the correction on the movement amount of relatively moving the printer head 14 with respect to the work at the time of printing. In this case, in the printing target point setting process, the control device 24, for example, calculates the correction amount with respect to the control of relatively moving the printer head 14 with respect to the work according to the shift amount. In this case, the control of the relative movement of the printer head 14 is carried out while carrying out the correction of the operation corresponding to the correction amount calculated by the printing target point setting process in the control for the relative movement control device by the control device 24. Even when configured in such a manner, the influence of the landing shift can be appropriately suppressed.

The present disclosure can be suitably utilized in, for example, a printing apparatus.

What is claimed is:

1. A printing apparatus that carries out printing on a surface of a printing target object having a three-dimensional shape based on a print image, which is an image to be printed, the printing apparatus comprising a printer head comprising a nozzle surface being a surface formed with a nozzle row where a plurality of nozzles, each of which discharges ink, are lined in a predetermined nozzle row direction;

a target object holding device that holds the printing target object, the target object holding device rotatably holding the printing target object with a rotating axis set in a three-dimensional space as a center;

a three-dimensional movement supporting device that movably supports the target object holding device in the three-dimensional space;

a head movement supporting device that movably supports the printer head so that the nozzle surface passes a position facing the surface of the printing target object held by the target object holding device;

a relative movement control device that carries out a control of relatively moving the printer head with respect to the printing target object held by the target object holding device by controlling an operation of the three-dimensional movement supporting device and the head movement supporting device; and a print control device that controls discharging of the ink from the printer head, the print control device setting a printing target point, which is a position where the ink is to be discharged from at least some nozzles in the nozzle row, on the surface of the printing target object, and discharging the ink from a nozzle in the nozzle row to the printing target point based on the print image in accordance with the control of the relative movement by the relative movement control device; wherein the print control device carries out, for a process of setting the printing target point, at least an ideal landing point calculation process of calculating an ideal landing point, which is an ideal landing point of the ink discharged from the nozzle in the nozzle row, the ideal landing point calculation process calculating the ideal landing point based on the shape of the surface of the printing target object without limiting a condition that the plurality of nozzles are linearly lined in the nozzle row, an actual landing point calculation process of calculating an actual landing point, which is a landing point of the ink dischargeable from the nozzle in the nozzle row, the actual landing point calculation process calculating the actual landing point based on the shape of the surface of the printing target object under a condition that the plurality of nozzles are linearly lined in the nozzle row, and a printing target point setting process of setting the printing target point on the surface of the printing target object, the printing target point setting process setting the printing target point with respect to each position based on the ideal landing point and the actual landing point corresponding to each position on the surface of the printing target object, and when positions are shifted between the ideal landing point and the actual landing point corresponding to an identical position on the surface of the printing target object, a correction corresponding to a position shift amount is carried out to set the printing target point in the printing target point setting process.

2. The printing apparatus according to claim 1, wherein in the printing target point setting process, the print control device generates a corrected image in which the print image is corrected according to the position shift amount, and controls the discharging of the ink from the printer head to print the corrected image.

3. The printing apparatus according to claim 1, wherein in the printing target point setting process, the print control device calculates a correction amount with respect to the control of relatively moving the printer head with respect to the printing target object according to the position shift amount; and the relative movement control device controls the relative movement while carrying out the correction of an operation corresponding to the correction amount calculated by the printing target point setting process.

4. The printing apparatus according to claim 3, wherein in the printing target point setting process, the position shift amount used for the correction when the positions are shifted between the ideal landing point and the actual landing point is a distance between the ideal landing point and the actual landing point along the surface of the printing target object.

5. The printing apparatus according to claim 4, wherein when a line going around the surface of the printing target object along a position where a plane perpendicular to the rotating axis and the surface of the printing target object intersect once is defined as a cross-sectional outer peripheral line, the print control device calculates a plurality of ideal landing points lined along the cross-sectional outer peripheral line so as to line at an equal interval along the cross-sectional outer peripheral line in the ideal landing point calculation process.

6. The printing apparatus according to claim 5, wherein in the printing target point setting process, the print control device sets a nozzle row correspondence line, which is a line extending on the surface of the printing target object to overlap, when seen from the printer head side, with respect to a line connecting nozzles at both ends in the nozzle row; and carries out the correction so that a landing point of the ink discharged from a nozzle other than at both ends in the nozzle row is on the nozzle row correspondence line to set the printing target point.

7. The printing apparatus according to claim 6, wherein the relative movement control device controls the relative movement so that the nozzle surface of the printer head maintains a predetermined interval with respect to the printing target point and so that the nozzle surface becomes parallel to a tangent plane of the printing target point.

8. The printing apparatus according to claim 7, wherein the relative movement control device executes a process of obtaining a line segment of a length same as the nozzle row arranged on an outer peripheral line of the printing target object in an orthogonal plane orthogonal to a reference plane, acting as a reference to start printing on the printing target object and being orthogonal to the rotating axis, and passing through the rotating axis, and a normal vector orthogonal to the tangent plane of the printing target point; and a process, of carrying out a control of relatively moving the printer head with respect to the printing target object so that the nozzle row faces the line segment and the nozzle surface becomes orthogonal to the normal vector.

9. A control method for a printing apparatus for controlling an operation of the printing apparatus that carries out printing on a surface of a printing target object having a three-dimensional shape based on a print image, which is an image to be printed, wherein the printing apparatus comprises a printer head comprising a nozzle surface being a surface formed with a nozzle row where a plurality of nozzles, each of which discharges ink, are lined in a predetermined nozzle row direction, a target object holding device that holds the printing target object, the target a target object holding device that holds the printing target object, the target object holding device rotatably holding the printing target object with a rotating axis set in a three-dimensional space as a center, a three-dimensional movement supporting device that movably supports the target object holding device in the three-dimensional space, and a head movement supporting device that movably supports the printer head so that the nozzle surface passes a position facing the surface of the printing target object held by the target object holding device, for a control on the printing apparatus, a relative movement control, a control of relatively moving the printer head with respect to the printing target object held by the target object holding device by controlling the operation of the three-dimensional movement supporting device and the head movement supporting device, and a print control, a control on discharging of the ink from the printer head, the print control comprising setting a printing target point, which is a position where the ink is to be discharged from at least some nozzles in the nozzle row, on the surface of the printing target object, and discharging the ink from a nozzle in the nozzle row to the printing target point based on the print image in accordance with the control of the relative movement by the relative movement control are carried out;

in the print control, for a process of setting the printing target point, at least an ideal landing point calculation process of calculating an ideal landing point, which is an ideal landing point of the ink discharged from the nozzle in the nozzle row, the ideal landing point calculation process calculating the ideal landing point based on a shape of the surface of the printing target object without limiting a condition that the plurality of nozzles are linearly lined in the nozzle row, an actual landing point calculation process of calculating an actual landing point, which is a landing point of the ink dischargeable from the nozzle in the nozzle row, the actual landing point calculation process calculating the actual landing point based on the shape of the surface of the printing target object under a condition that the plurality of nozzles are linearly lined in the nozzle row, and a printing target point setting process of setting the printing target point on the surface of the printing target object, the printing target point setting process setting the printing target point with respect to each position based on the ideal landing point and the actual landing point corresponding to each position on the surface of the printing target object are carried out; and when positions are shifted between the ideal landing point and the actual landing point corresponding to an identical position on the surface of the printing target object, a correction corresponding to a position shift amount is carried out to set the printing target point in the printing target point setting process.

10. A printing method for carrying out printing using a printing apparatus that carries out printing on a surface of a printing target object having a three-dimensional shape based on a print image, which is an image to be printed, wherein the printing apparatus comprises a printer head comprising a nozzle surface being a surface formed with a nozzle row where a plurality of nozzles, each of which discharges ink, are lined in a predetermined nozzle row direction, a target object holding device that holds the printing target object, the target object holding device rotatably holding the printing target object with a rotating axis set in a three-dimensional space as a center, a three-dimensional movement supporting device that movably supports the target object holding device in the three-dimensional space, and a head movement supporting device that movably supports the printer head so that the nozzle surface passes a position facing the surface of the printing target object held by the target object holding device, with respect to the printing apparatus, a relative movement control, a control of relatively moving the printer head with respect to the printing target object held by the target object holding device by controlling an operation of the three-dimensional movement supporting device and the head movement supporting device, and a print control, a control on discharging of the ink from the printer head, the print control comprising setting a printing target point, which is a position where the ink is to be discharged from at least some nozzles in the nozzle row, on the surface of the printing target object, and discharging the ink from a nozzle in the nozzle row to the printing target point based on the print image in accordance with the control of the relative movement by the relative movement control are carried out;

in the print control, for a process of setting the printing target point, at least an ideal landing point calculation process of calculating an ideal landing point, which is an ideal landing point of the ink discharged from the nozzle in the nozzle row, the ideal landing point calculation process calculating the ideal landing point based on a shape of the surface of the printing target object without limiting a condition that the plurality of nozzles are linearly lined in the nozzle row, an actual landing point calculation process of calculating an actual landing point, which is a landing point of the ink dischargeable from the nozzle in the nozzle row, the actual landing point calculation process calculating the actual landing point based on the shape of the surface of the printing target object under a condition that the plurality of nozzles are linearly lined in the nozzle row, and a printing target point setting process of setting the printing target point on the surface of the printing target object, the printing target point setting process setting the printing target point with respect to each position based on the ideal landing point and the actual landing point corresponding to each position on the surface of the printing target object are carried out; and when positions are shifted between the ideal landing point and the actual landing point corresponding to an identical position on the surface of the printing target object, a correction corresponding to a position shift amount is carried out to set the printing target point in the printing target point setting process.

* * * * *